US008109062B2

(12) United States Patent
Chase et al.

(10) Patent No.: US 8,109,062 B2
(45) **Date of Patent: *Feb. 7, 2012**

(54) PACKAGING CASE CLOSING AND TAPE SEALING MACHINE AND PROCESSES

(75) Inventors: Allen Jerome Chase, Spokane, WA (US); Donald Parker, Cheney, WA (US); Richard R Lile, Spokane, WA (US)

(73) Assignee: R.A. Pearson Company, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/024,587

(22) Filed: Feb. 10, 2011

(65) Prior Publication Data

US 2011/0131925 A1 Jun. 9, 2011

Related U.S. Application Data

(63) Continuation of application No. 10/738,969, filed on Dec. 16, 2003, now Pat. No. 7,886,503.

(51) Int. Cl.
*B65B 57/04* (2006.01)
*B65B 7/20* (2006.01)
*B65B 51/00* (2006.01)

(52) U.S. Cl. ..... 53/76; 53/75; 53/377.2; 53/378.3

(58) Field of Classification Search ..... 53/75, 76, 53/376.4, 377.2, 378.3, 415, 419
See application file for complete search history.

(56) References Cited

U.S. PATENT DOCUMENTS

| | | | | | |
|---|---|---|---|---|---|
| 3,716,962 | A | * | 2/1973 | Langen et al. | 53/209 |
| 3,769,777 | A | * | 11/1973 | Miller et al. | 53/76 |
| 3,775,937 | A | | 12/1973 | Devan et al. | |
| 3,959,950 | A | * | 6/1976 | Fukuda | 53/467 |
| 3,973,375 | A | * | 8/1976 | Loveland | 53/377.3 |
| 4,010,597 | A | * | 3/1977 | Nelson | 53/376.5 |
| 4,063,403 | A | | 12/1977 | Bergstein et al. | |
| 4,079,577 | A | | 3/1978 | Ulrich et al. | |
| 4,213,285 | A | | 7/1980 | Mancini | |
| 4,233,798 | A | | 11/1980 | Helding | |
| 4,293,086 | A | * | 10/1981 | Fincher et al. | 225/1 |
| 4,317,319 | A | | 3/1982 | Price | |

(Continued)

OTHER PUBLICATIONS

Pearson Packaging Systems, Model N475 Random Top Seal Taper pp. 1-2 from catalog.

*Primary Examiner* — Sameh H. Tawfik
*Assistant Examiner* — Gloria R Weeks
(74) *Attorney, Agent, or Firm* — Lee & Hayes, PLLC

(57) ABSTRACT

A machine for closing and sealing cardboard boxes or other packaging cases with random sizes of cases presented. An input gate controls passage of cases onto at least one conveyor that moves the cases through the machine. An input positioning stage centers and squares the case. A measuring station performs a primary measurement of the width and height of the open case. A closing station and tape sealing station are adjusted to the primary case size measurement. The case closing station then closes the case. The side major flaps are closed using a major flap closer with crossed arms pivoted at separated pivot axes. The sealing station has a secondary or closed case measurement detector which more accurately adjusts the tape applicator height. Lateral support heads engage the sides of the case to prevent distortion while tape is applied.

17 Claims, 16 Drawing Sheets

U.S. PATENT DOCUMENTS 4,422,282 A 12/1983 Marchetti
4,478,023 A 10/1984 Becker
4,517,784 A 5/1985 Beckett
4,524,560 A 6/1985 Goodman
4,543,767 A * 10/1985 Wiseman ..... 53/76
4,545,175 A 10/1985 Beckett
4,562,686 A * 1/1986 Focke ..... 53/377.3
4,565,050 A * 1/1986 Norris ..... 53/491
4,722,165 A 2/1988 Marchetti
4,778,554 A * 10/1988 Doman ..... 156/321
4,781,786 A 11/1988 Lerner et al.
4,955,177 A * 9/1990 Lerner et al. ..... 53/136.4
4,984,409 A * 1/1991 Focke ..... 53/53
5,022,214 A * 6/1991 Kim ..... 53/242
5,063,726 A 11/1991 Boisseau
5,102,382 A 4/1992 Center et al.
5,255,490 A * 10/1993 Chiu ..... 53/136.4
5,323,586 A 6/1994 Lissoni et al.
5,341,626 A * 8/1994 Beckmann ..... 53/566
5,454,776 A 10/1995 Ulrich et al.
5,685,814 A 11/1997 Le
6,067,773 A 5/2000 Le
6,070,396 A * 6/2000 Rinaldi et al. ..... 53/504
6,318,049 B1 11/2001 Raudat et al.
6,401,587 B1 * 6/2002 Beltrandi ..... 83/879
6,725,629 B2 * 4/2004 Pearce et al. ..... 53/473
6,910,314 B2 6/2005 Le
7,140,165 B2 11/2006 Ventura et al.
7,269,933 B2 9/2007 Le
7,278,248 B2 10/2007 Vinh Le
7,383,864 B2 6/2008 Hogerton et al.
2002/0170271 A1 * 11/2002 Pearce et al. ..... 53/445
2004/0068956 A1 * 4/2004 Hartness et al. ..... 53/247
2004/0093829 A1 5/2004 Marchetti
2004/0123559 A1 7/2004 Le
2004/0226268 A1 * 11/2004 Vinh Le ..... 53/491

* cited by examiner

PACKAGING CASE CLOSING AND TAPE SEALING MACHINE AND PROCESSES

RELATED APPLICATIONS

This patent application claims priority to U.S. patent application Ser. No. 10/738,969, titled "Packaging Case Closing and Tape Sealing Machine and Process", filed on Dec. 16, 2003, now issued as U.S. Pat. No. 7,886,503, commonly assigned herewith, and hereby incorporated by reference.

TECHNICAL FIELD

The invention relates to machines and processes used to measure incoming packaging cases of random sizes and fold the packaging cases into a closed condition for sealing, particularly when using adhesive faced tape.

BACKGROUND OF THE INVENTION

There are many instances in the distribution of goods where different sizes and shapes of packaging cases, such as cardboard boxes, are presented for closure and sealing. In the past it has been relatively slow and difficult to accommodate these randomly sized cases using a single machine. This is due in part to the adjustments that must be made between differently sized cases being closed and sealed in a serial manner.

In many instances, the desired method of sealing is using an adhesively faced tape applied to the case after the flaps have been folded down. Adhesive tape sealing is often used where the cases or cartons are made of corrugated cardboard. The application of adhesively faced tapes has special challenges and requires different handling than other closure techniques due in part to the particularities of presenting and applying the thin, flexible adhesive tape stock. Having the tape be applied so that it is smooth and relatively tight presents special problems and considerations.

Another problem in the handling and sealing of randomly sized cases is the need to reposition the operative parts of the machine for each box or case. Varying heights of cases require elevational changes for both the closing and sealing stages. The size of the major flaps depends on the width of the cases which have associated varying flap widths. The randomly sized cases must be closed reliably even though both the height and width may vary over the total acceptable size range capability between two successive cases.

The sealing tape used on many cases must also be applied smoothly and evenly although the mechanism accomplishing this is adjusting for each case being processed. To do this and maintain a high rate of throughput is a great challenge. The frequent positioning adjustments also tend to increase maintenance costs because of the accelerations and forces developed in the machine due to such frequent positioning changes which are desirably accomplished at high speeds.

Prior random case closing and sealing apparatus have in general operated slowly thus requiring more machines to process the same throughput of cases per time period. Since the machines have a significant cost, increasing the throughput while still providing reliable closure and sealing of randomly sized cartons without shutdowns is a significant advancement and represents significant economic savings.

The current invention addresses one or more of these problems and challenges using a number of features that provide improved processing of packaging cases which have major and minor flaps that are closed and then sealed, particularly when using an adhesively faced sealing tape.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Introductory Note

The readers of this document should understand that the embodiments described herein may rely on terminology used in any section of this document and other terms readily apparent from the drawings and language common therefore. This document is premised upon using one or more terms with one embodiment that will in general apply to other embodiments for similar structures, functions, features and aspects of the invention. Wording used in the claims is also descriptive of the invention. Terminology used with one, some or all embodiments may be used for describing and defining the technology and exclusive rights associated herewith.

First Embodiment Machine

General Configuration of First Embodiment Machine

Figure 1:
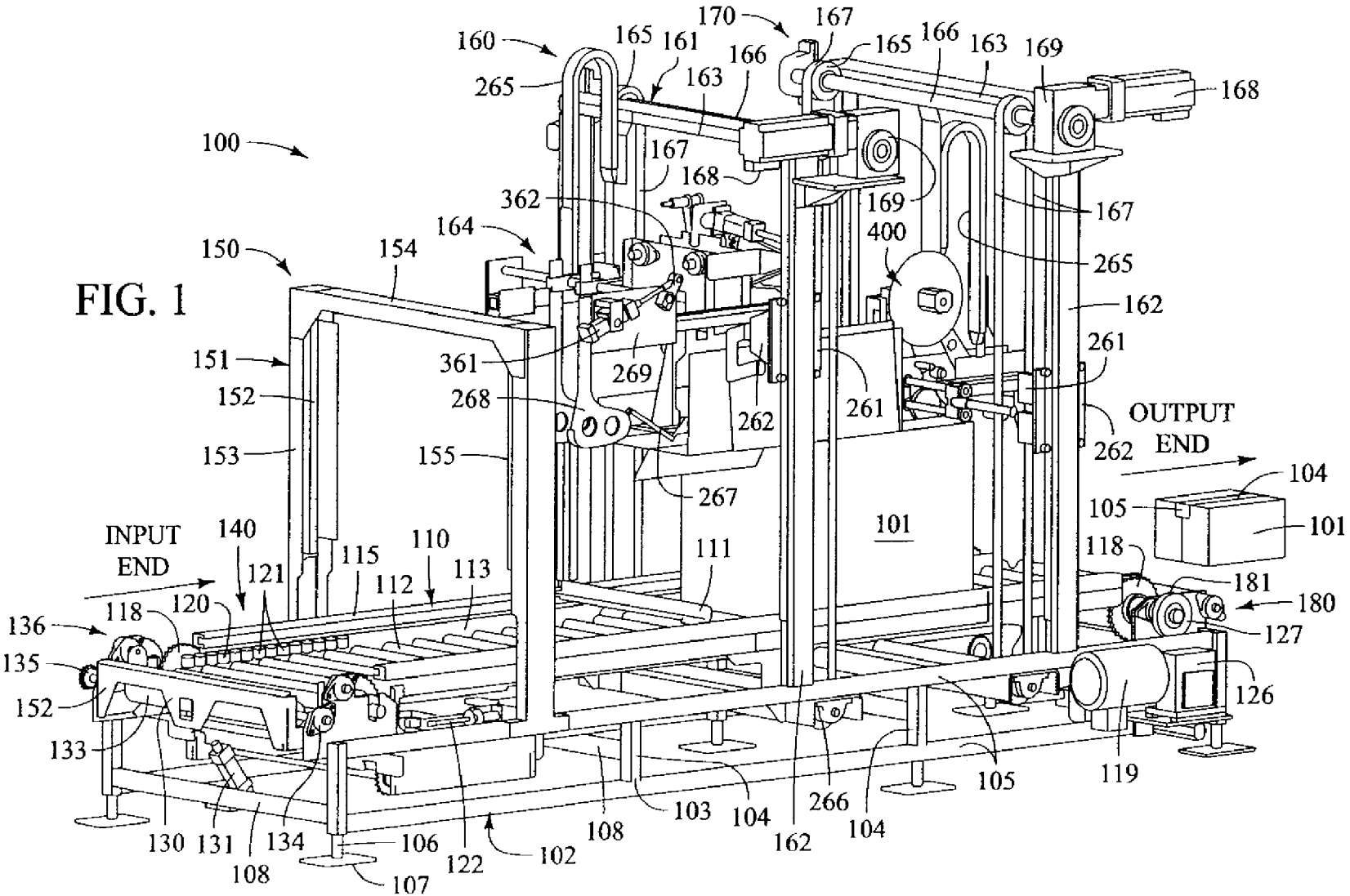
FIG. 1 is a perspective view showing a first machine according to the invention.

FIG. 1 shows a first embodiment machine 100 according to the invention. Machine 100 includes several different subsystems or stages which will be introduced now and described in greater detail hereinafter.

Machine 100 includes a conveyor frame or framework 102 used to support the machine upon a supporting floor or other supporting structure (not shown). The frame also serves to mount and support a number of other components as is shown and will be described in detail hereinafter. A particular framework is shown, although a variety of frame constructions can be used within the concepts of this invention.

Machine 100 also includes one or more conveyors 110 forming a conveyor train which moves packaging cases 101 through the machine. FIG. 1 shows a relatively larger case being operated upon and a relatively smaller case being output. This illustrates the random case size capability possible using the novel concepts taught herein.

Incoming cases are controlled using an input gate 130 that stops cases in an input queue as needed outside the machine (as shown). The gate then allows a single case to proceed into the receiver stage 140.

FIG. 1 also shows that machine 100 includes centering and squaring mechanism 120. This mechanism is included at or near the input end, such as at the receiver stage 140. The mechanism 120 used in this embodiment has a series of rollers 121 which are mounted to extend toward and away from the effective centerline of the machine to square the case relative to the conveyor centerline and direction of movement.

FIG. 1 also shows a case measuring stage 150. The case measuring stage measures the height and width of the case. This information is used to set the height of the closing stage and sealing stages described briefly below.

The closing stage 160 adjusts to the measured size of the case. It is used to close the flaps of the case in preparation for sealing of the case using the sealing stage 170. The sealing stage is preferably a tape applicator that covers the center flap joint of the case with a sealing adhesive tape in the well-known fashion.

Machine 100 also includes an output stage 180 that accelerates the closed and sealed case 101 and propels it onto another conveyor (not shown) or otherwise outputs the case to an associated output station (not shown).

Packaging Cases

The preferred packaging cases used with machine 100 are typically cardboard boxes or cases having a orthogonal parallelepiped finished shape. The well-known configuration of the cases includes four flaps at the top and typically four flaps at the bottom. Cases 101 are fed to the machine 100 in an erected condition with the top flaps open in an upstanding and unsealed condition. The bottom flaps are folded into a closed condition when the cases are fed to machine 100.

The cases may be fed with the bottom flaps either sealed or not sealed. If the bottom flaps are not sealed, then it is possible to include an optional second or bottom tape applicator (not shown) which applies a sealing tape to the bottom flaps.

The cases 101 include minor flaps that are folded down first. The front minor flap approaches machine 100 first. The rear minor flap approaches the machine 100 second. The cases also have side or major flaps that are folded at the fold joint or score line along the outside corner of the case parallel to the direction of movement through machine 100. The major flaps have exposed outer surfaces when the case is closed, as shown in the output case 101. The major flaps have distal edges which are upward when open and folded downward by the closing stage 160. The distal edges of the major flaps are folded down into adjacent positions to form the center joint 104 of output case 101. The major flaps are joined by the overlapping sealing tape 105.

Framework

Framework 102 preferably includes side members 103 which extend longitudinally along machine 100. The side member 103 are advantageously formed in a truss configuration with upright strut pieces 104 that are welded or otherwise joined to horizontal members 105.

The framework also includes adjustable legs 106 with attached foot pads 107. The legs and foot pads are used to support and level the machine on a supporting floor (not shown). Transverse members 108 extend transversely between the port and starboard side members 103 at desired locations along the framework.

Input and Receiver Stage

The input end of machine 100 includes an input control gate assembly 130. Gate assembly 130 has an actuator 131 which is connected to the frame at the lower end and to a movable assembly at the upper end. Contraction of actuator 131 causes the input gate 130 to pivot downwardly when a case is desired.

The input stage also preferably includes an infeed roller 133 supported for rotation by infeed roller bearings 134 upon the framework. The infeed roller 133 is preferably a driven roller having a drive sprocket 135 and associated drive chain (not shown). The sprocket 135 is driven using an infeed roller drive assembly 136 which advantageously includes an electric motor and drive gearing and drive sprocket that powers the sprocket 135 using a drive chain (not shown). The infeed roller is used to accelerate an incoming case into the receiver stage 140.

Case Conveyor Train or Assembly

As shown in this embodiment, the conveyor train includes a single conveyor 110. Conveyor 110 is a flight conveyor having transverse flight elements 111 which engage the rear face of the cases and propel them through the machine. The cases are supported upon a series of freely rotatable conveyor support rollers 112 which are mounted for rotation at opposing sides of the conveyor by a roller support member 113 and suitable bearings. Also supporting the cases are stationary case support plates or dead plates (not viewable in FIG. 1) beneath case 101.

The transverse flights are trained through a pair of side guide pieces 115 that have channels therein which receive a conveyor flight chain (not illustrated). The conveyor flight chain is also trained about end sprockets 118 mounted for rotation relative to the framework. A conveyor drive motor 119 drives the conveyor flight chains using a speed reduction mechanism which can be of various types and configurations. As shown, the speed reduction mechanism includes a gear reduction transmission 126 which has a belt sheave (not shown) that drives a drive belt (not shown) that drives the illustrated conveyor drive sheave 127. The shaft or shafts connecting sheave 127 and drive sprocket 118 extend across the machine to drive the opposite side flight conveyor drive chain (not illustrated).

In the first embodiment the flight conveyor is controlled using a suitable flight conveyor drive motor. A preferred conventional AC motor 119 is shown to move the flight conveyor at a constant or approximately constant speed in automatic mode. The machine also preferably has a manual mode which operates at a slower speed and allows jogging the cases. In automatic mode the cases are not stopped during movement through the machine. Upon entering the machine the case waits briefly until the next flight pushes or moves the case through the machine.

Case Squaring and Centering Stage

As explained briefly above, machine 100 also preferably includes a case squaring subassembly which also advantageously serves to center or approximately center the cases upon the conveyor train. In machine 100 this is provided in the form of opposing roller sets 120 having rollers 121 that bear upon the lateral or outside walls of the case.

The roller sets and rollers 121 are mounted for extension and retraction from each side of machine 100 in a manner that extends and retracts them equal distances and parallel to the centerline of the conveyor. This is done using a roller set operator 122 which is advantageously a pneumatic operator in the form of a pneumatic ram or cylinder with an extensible rod that is coupled to an operator coupling mechanism that extends both an equal distance from the sides of the conveyor. The mechanism for accomplishing this can be chosen from a variety of suitable types. A suitable mechanism is described below in connection with the second embodiment. Other mechanisms are also useful for this purpose.

The rollers 121 are mounted for revolution upon roller axes that are along a line parallel to the centerline of the conveyor. The rollers thus engage the outside walls of packaging cases and square the cases relative to the conveyor and centerline of the machine.

Since the rollers extend in concert equal amounts they also can be used to measure the width of the cases. This is accomplished by using a detector mechanism attached to the operator 122. This can be done using a linear transducer which acts as a detector and provides an indication of the extension of the roller sets. Alternatively, the squaring and centering can be accomplished without a detector connected thereto if alternative means for measuring the width of the cases is provided, such as is described below in connection with the second embodiment.

Case Measuring Stage

The machine 100 uses suitable measuring detectors to determine the necessary parameters for the size of case being closed and sealed. Measuring stage 150 advantageously uses an array of optical emitters and detectors mounted upon a measuring stage mast structure 151. The mast structure includes upright member 153 secured to the framework along opposing sides of the machine. A top mast member 154 preferably extends between the top ends of members 153 to stabilize the mast structure. It can also be used to mount size measuring detectors if desired.

In the embodiment shown, the height of an open incoming case is measured using optical emitters and detectors. The optical emitters are advantageously in the form of light emitting diodes (LED) 152. The LEDs are mounted in a vertical array along the inside of one of the two upright members 153 of mast structure 151. The emitters are advantageously spaced at increments of about 0.1 inch and are directed to beam across to the opposite mast upright which mounts corresponding optical detectors 155. The optical detectors may be various, electronic photodetectors which sense the beams. The last beam blocked or lowest beam that passes across between the pairs of emitter-detectors indicates the approximate height of the open case being measured. The array is sequentially scanned to quickly measure height of a case.

Case Closing Stage Generally

Machine 100 also includes a case closing stage 160. Case closing stage 160 includes a structural mast 161 which preferably comprises side pieces 162 and transverse piece 163. Mast 161 mounts a closing stage movable assembly 164. The movable assembly is moved by a movable a assembly operator preferably in the form of driver assembly 165.

Case Closing Stage Movable Assembly Operator

The closing stage driver assembly 165 is configured to move the movable assembly 164 in a vertical or upstanding orientation. It has a upper shaft 166 which is rotatably mounted upon the mast 161 and a lower shaft 266 rotatably mounted to the frame. Sheaves are beneficially provided near each end of the shafts for moving drive belts 167 in either direction in a controlled manner by servomotor 168. The mechanical output of servomotor 168 is advantageously mechanically coupled to the upper shaft by a gear set 169 having a right angle drive configuration. The gear set and motor are supported on a motor mount supported by mast 161.

The movable assembly 164 is coupled to the drive belts 167 with assembly couplings 261 which are attached to trolleys 262 engaged with the mast upright along both sides thereof. The trolleys carry the fore-aft and lateral loadings to the mast which occur in accelerating the movable assembly. The vertical loading is carried through the trolleys to the belt couplings 261 and to belts 167.

The closing stage also has a collection of control wiring and pneumatic lines which run between the stationary frame and the movable assembly 164 using a flexible cable guide 265 supported by the mast and looped over to the movable assembly.

Closing Stage Movable Assembly Features

The movable assembly 164 is provided with a number of features that perform a plurality of functions. One function is to close the front minor flap of the cases. Another function is to close the rear minor flap of the cases. A further function is to close the side or major flaps. The closure of the major flaps for a variety of case sizes is difficult and the invention includes a novel construction for this purpose. The movable assembly also must move up and down to accommodate the various heights of cases and widths of the major flaps. These functions and preferred structures and processes therefore are described in greater detail hereinafter.

Front Minor Flap Closer

One feature is to include at least one front minor flap closing structure. This is advantageously in the form of a pair of static closing irons 267. The distal portions of the irons 267 are inclined to depress and turn the front minor flap rearwardly and into the interior of the case.

Rear Minor Flap Closing Mechanism

The movable assembly also includes a rear minor flap closer which is preferably in the form of a rear flap kicker having dual kicking legs 268. The kicking legs are mounted for pivotal action to the subframe 269 of the movable assembly. The kickers are operated by a pneumatic or other suitable operator such as shown in FIG. 1 with the pneumatic operator 361 being connected to the subframe using a swivel connection mount. The output rod from pneumatic cylinder operator 361 extends and retracts axially and is pivotally connected to a shaft crank arm 362. The kicker pivot shaft is nonrotatably connected to shaft crank arm 362 and kicker legs 268 to allow pivotal action of the kicker legs for closing the rear minor flap of each case.

Major Flap Closing Mechanisms

Figure 2:
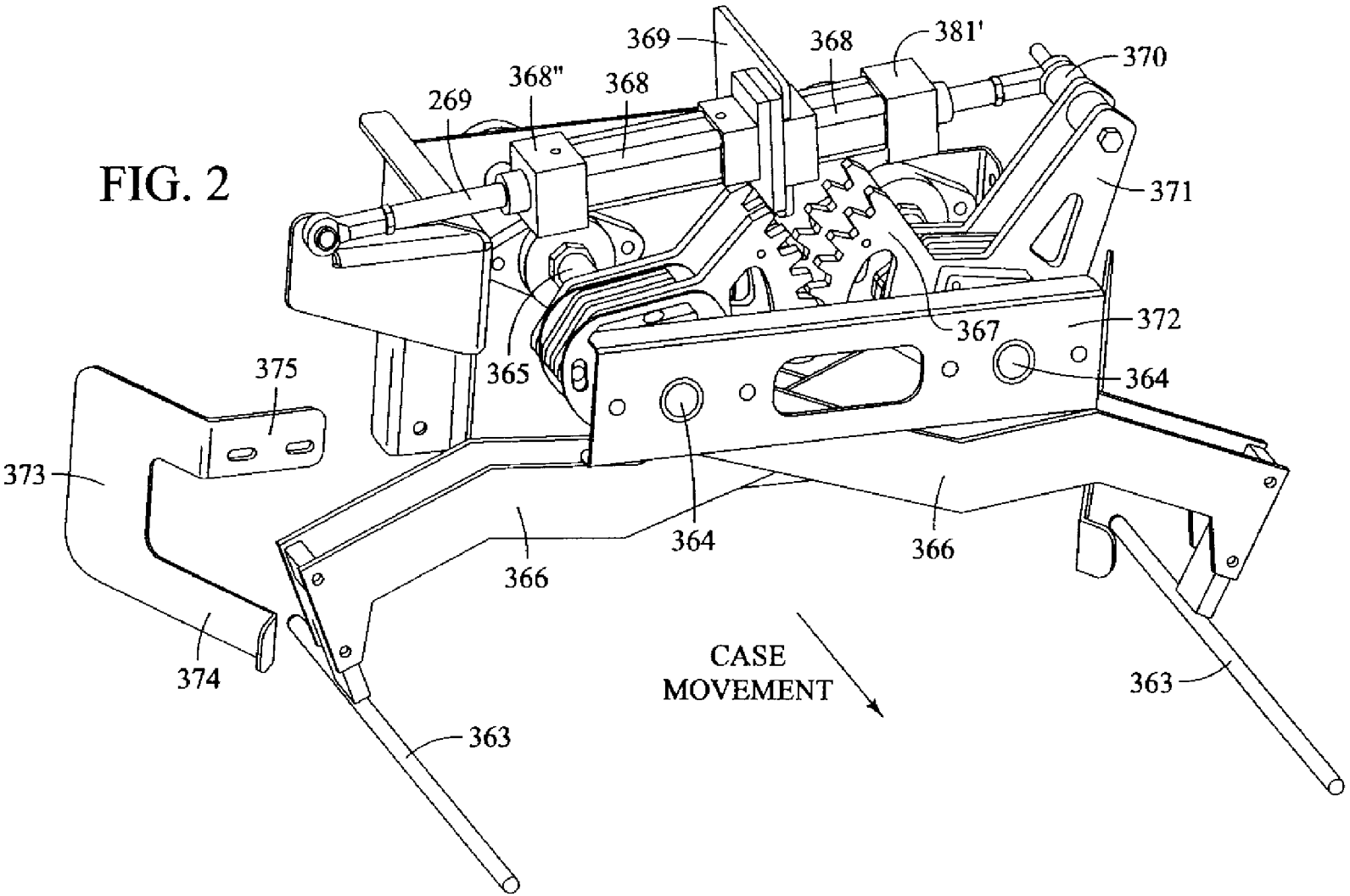
FIG. 2 is a perspective view showing in isolation portions of a major flap folding mechanism forming a part of the machine of FIG. 1.

FIG. 2 shows an enlarged isolated view of key parts of the major flap closing mechanisms forming parts of the movable assembly 164. The first major flap closer is a dynamic closing mechanism that has two contacts in the form of contact bars 363. Contact bars 363 move in a downward arc as determined by their respective pivot axes 364. Pivot axes 364 are defined by shafts 365 mounted to the movable assembly subframe 269. The bars are preferably oriented to be parallel to the centerline of the machine conveyor throughout their swing range.

The contact bars 363 are mounted upon swing arms 366 which extend from pivot axes 364 in a crossed arm arrangement which places the associated pivot axis on the opposite side of the centerline of the machine conveyor along which cases move. The swing arms 366 are coordinated by a pair of coordinating swing arm gear sets 367 which are secured to the swing arms against relative pivotal action such that the swing arms and gears joined at a pivot axis move in pivotal action together. The above construction causes the crossed opposing arms 364 at their distal ends with attached contact bars 363 to contract together and expand away from one another. This is done in a coordinated fashion by the gear sets. The contact bars move in complementary relationship as they swing upon the coordinated swing arms pivoted along opposite sides of the machine.

The swing arms are operated by one or more swing arm operators. As shown the swing arms are operated by a two-stage swing arm operator 368 having a first operator cylinder 368' and a second operator cylinder 368". The first and second operators are advantageously pneumatic and supplied with air in a controlled fashion that allow one to operate first and the other to operate second. This can be used to provide speedier operation. The operators are joined at a connection piece 369 with the extensible rod ends being pivotally connected to the movable assembly subframe and a pivot connection 370 to the gear sets 367 at lever arms 371. A support bar 372 is connected at the ends of the swing arm pivot shafts to better space the axes and allow the ends to be mounted to the subframe to mechanically support both ends of the swing arm pivot shafts.

The major flap folding mechanisms may also include a stationary static flap guard 373 along both sides of the movable assembly. The flap guard 373 preferably has two tangs. The lower tang or prong 374 has a crooked end and is positioned furthest from the centerline of the moving cases. The first tang contacts any widely spaced major flaps first and starts the flaps moving inwardly. A second tang or prong 375 is shown in an upper relationship to tang 374 and is oriented transversely to be mounted upon the movable assembly subframe thus supporting guard 373 therefrom.

Tape Sealing Stage Generally

Figure 3:
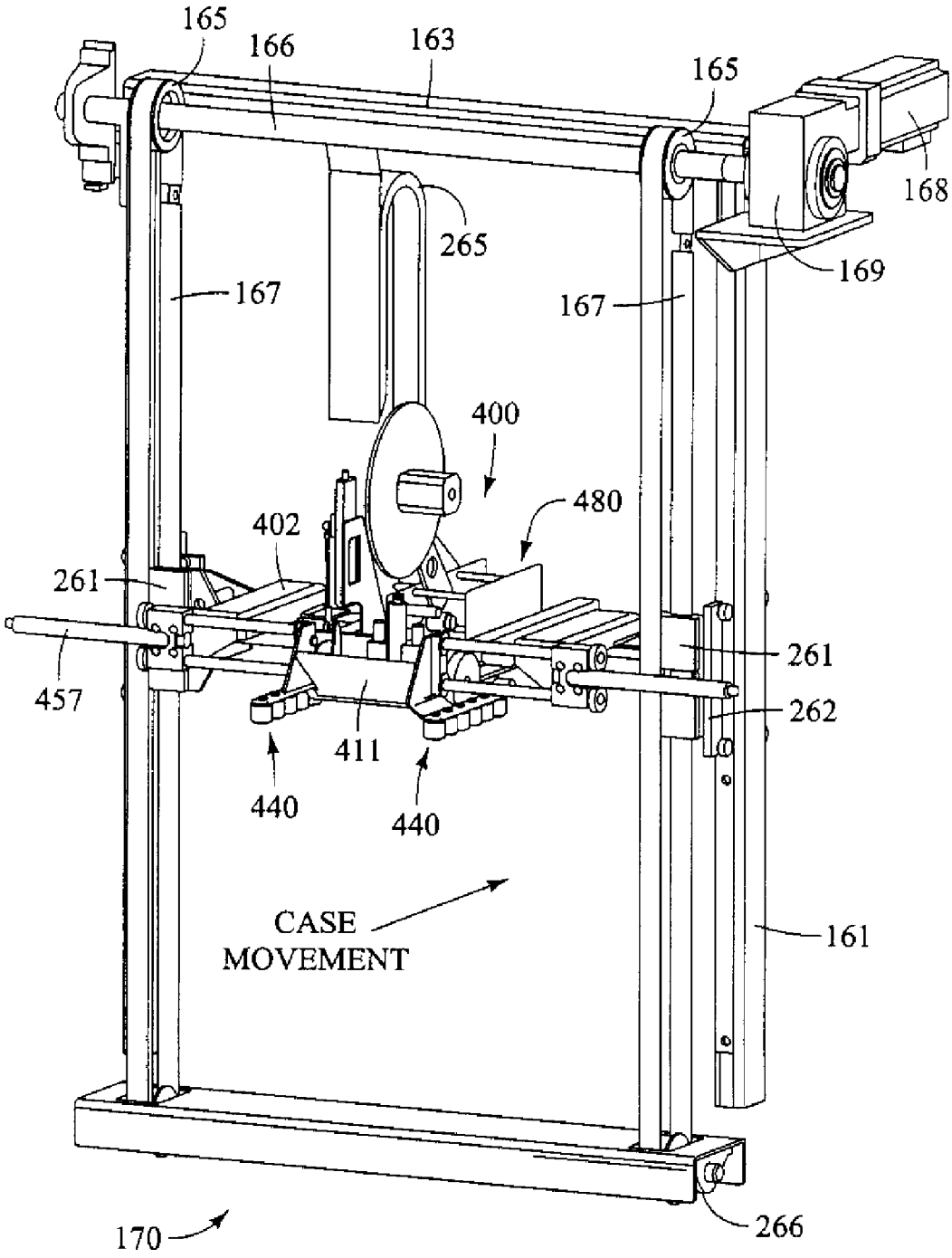
FIG. 3 is a perspective view showing in isolation portions of a case sealing stage of the machine of FIG. 1.

FIG. 3 shows the sealing stage 170 in isolation. Tape sealing stage 170 includes a mast and vertical operator construction which is substantially the same as that described above in connection with the closing stage 160. The same reference numbers are used to indicate the same or equivalent parts. These parts will not be re-explained for reasons of brevity. The description given above is incorporated by reference with regard to the tape sealing stage movable assembly operator.

Taping Stage Movable Assembly

The tape sealing stage 170 includes a movable assembly 400 which moves upwardly and downwardly as coupled by couplings 261 to drive belts 167. The movable assembly includes a subframe 402 which is connected to couplings 261 and trolleys 262. Other features and structures are provided on the movable assembly and are mounted to the subframe.

In brief, the tape sealing or taping stage 170 has features on the movable assembly 400 which detect the true height of the closed case using a secondary height detection system. The primary height detection is done by the measuring stage 150 as described hereinabove.

The taping stage also includes a lateral support subsystem that has lateral support subassemblies that support the sides of the case as secondary height detection is made and tape is applied to the folded or closed case exiting the closing stage. This provides close proximity between the distal edges of the major flaps and keeps the case in proper shape for secondary measuring and sealing. After sealing the structural support provided by the applied tape helps to maintain the shape of the closed and sealed case.

The taping stage also has a tape application subsystem that holds a supply of adhesively faced tape, dispenses the tape, tensions the tape, rolls the tape onto the surface of the major flaps of the case, and depresses and compresses the adhesive joint of the applied tape. The tape is also cut and wrapped over the leading and trailing edges of the major flap joint and onto the front and rear end walls of the case.

Taping Stage Secondary Height Detection Mechanism

Figure 4:
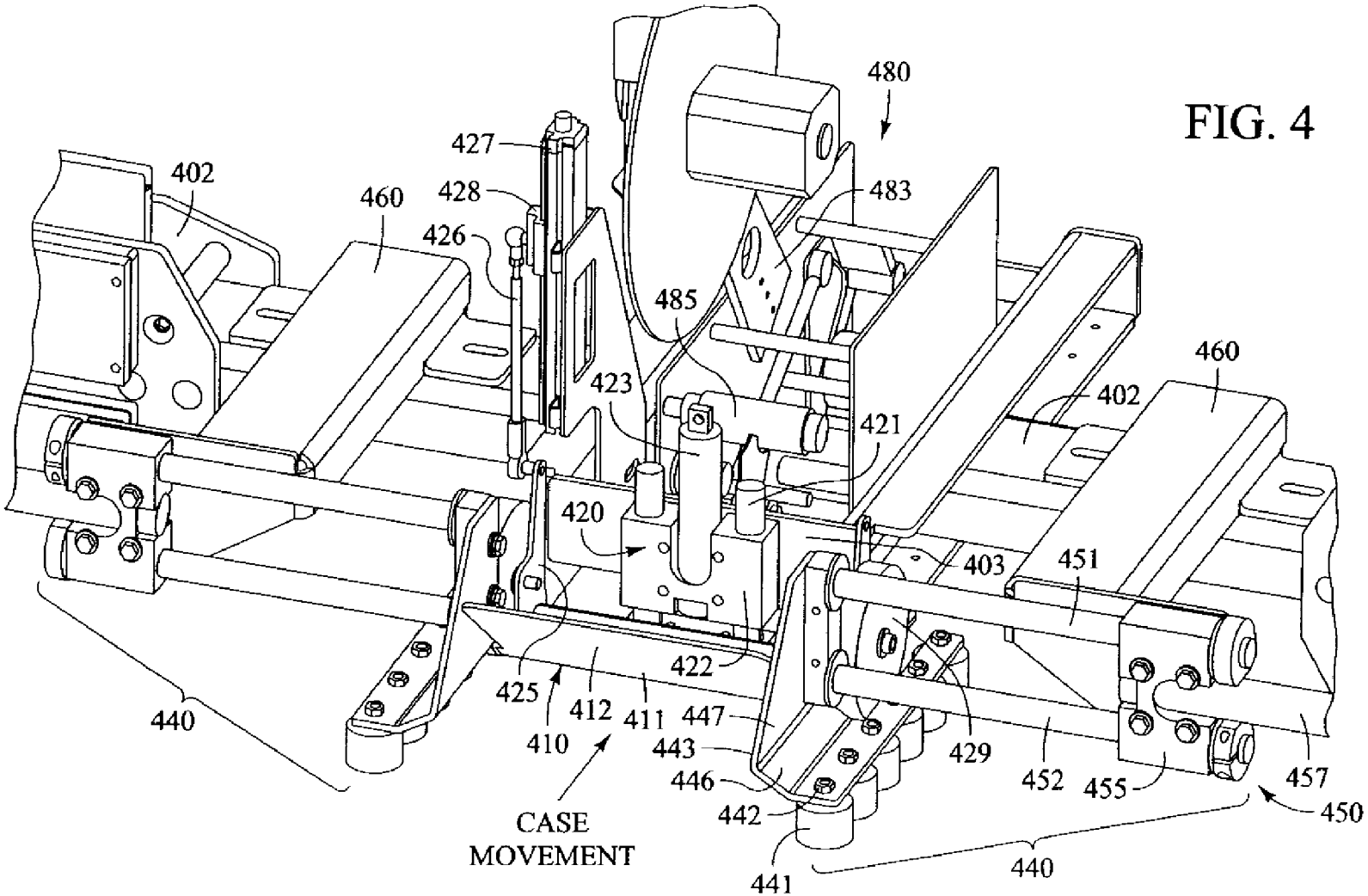
FIG. 4 is a perspective view showing in isolation and enlarged scale portions of the case sealing stage of the machine of FIG. 1.
Figure 5:
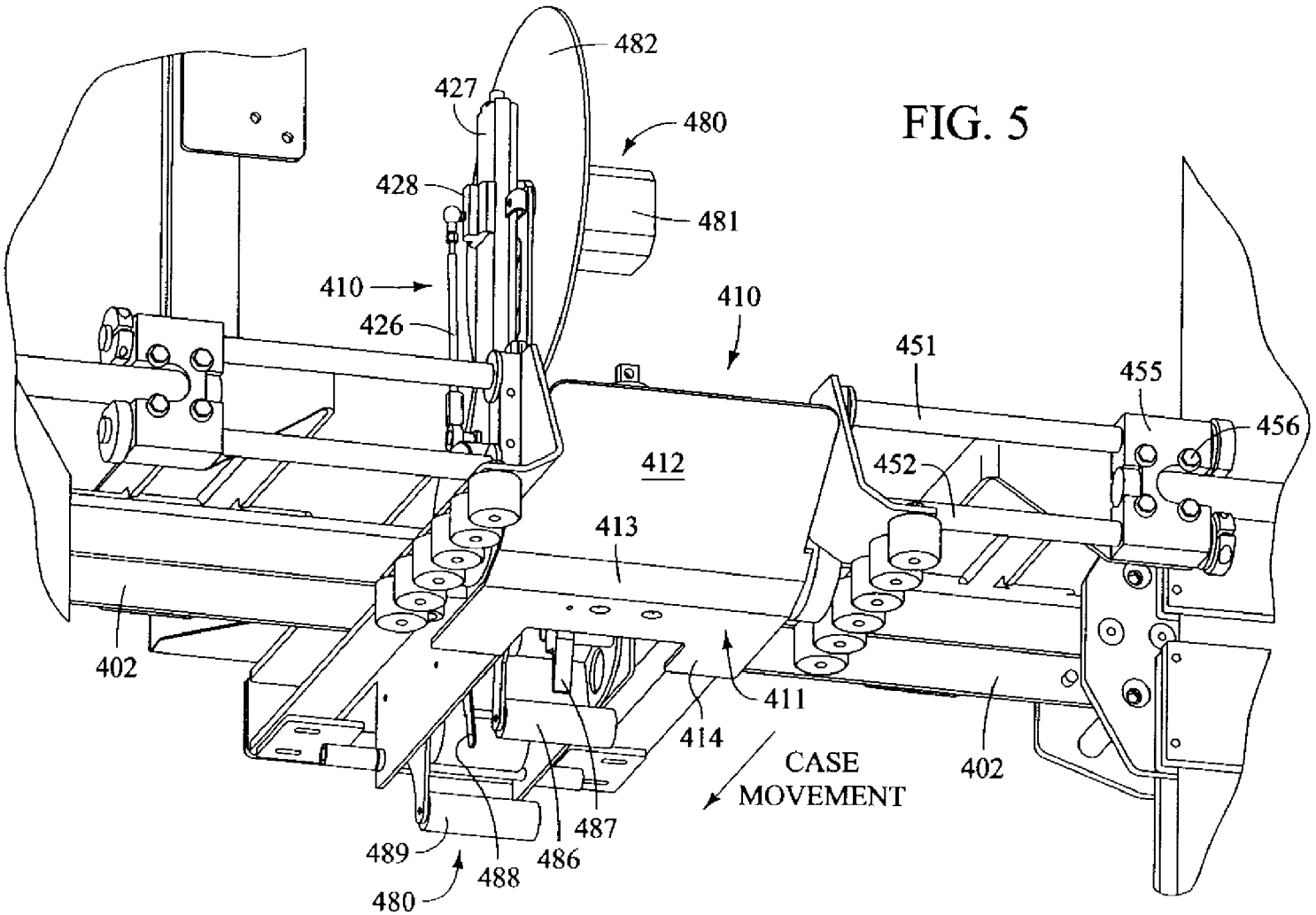
FIG. 5 is a perspective view taken from a forward or infeed underside viewpoint showing in isolation portions of the tape sealing stage of the machine of FIG. 1.

FIGS. 4 and 5 show enlarged the key operative components of the sealing stage movable assembly 400. In this embodiment, one part of the movable assembly is the secondary height detection subsystem 410. The secondary height detection could alternatively be mounted elsewhere.

As shown, the secondary height detection system includes a contact plate or piece 411 which is advantageously in the configuration of a ski shape with an upturned leading portion 412. Leading portion 412 transitions into a nose section 413. Nose portion 413 transitions into a base portion 414. This configuration allows the movable assembly to be set slightly below the estimated height of the closed case to provide full closure of the major flaps. The contact plate contacts an approaching nearly closed case and is forced upward slightly.

The secondary height contact 411 is mounted upon a suitable mount which is responsive to force and the actual height of the box as indicated by the movable contact. This is advantageously done by mounting the contact to the subframe 402 using a mounting piece 403 of the subframe and attached movable mounting mechanism. As shown, the movable is mounting mechanism for the contact 411 is in the form of a linear coupling 420 (see FIG. 4). The linear coupling has two opposing slide rods 421. A body piece 422 which is connected to the subframe slides on the slide rods upwardly and downwardly.

It has been found desirable in some instances to include a damper 423 which acts as a shock absorber and dynamic response control element. The preferred damper is supplied with compressed gas, such as air. The pressure supplied to the damper changes the dynamic response rate of the contact and prevents hopping of the contact upon engagement of the case against the contact 411. By adjusting this operational parameter, the machine can be adjusted for different types of cases having different structural rigidities and made of differing materials.

The secondary height detection system further includes a connection arm 425 which extends upwardly from the back of the contact and is secured to the contact to reflect the movement thereof. The end of the connection arm 425 is provided with a suitable pivotal connection to a detector connection linkage 426. The detector connection linkage 426 is coupled to the detector 427. Detector 427 is desirably a linear transducer that indicates position of the movable element 428 thereof in comparison to the body of the detector which is mounted to the movable assembly subframe. Secondary height detection transducer 427 preferably produces an electrical detection signal which is used to control the movable assembly height by moving the drive motor 168 and mechanically coupled drive belts 167. This is used to provide proper elevational positioning of the movable assembly of the tape sealing stage 170. This greater accuracy of the tape sealing stage allows increased throughput rates to be achieved because the tape application is done at a proper or optimal height and the process can be performed more speedily.

The secondary height detector is similar to the detector used for width measurement described above. Secondary measurement compensates for variable corrugated wall thickness and allows for slight over-packing of cases by the user of the machine. Thus, tape sealing can be performed more reliably in same applications where random cases may be over-packed in some instances and less-than-packed in other instances. The inventions can thus provide variable package tensions to be accommodated with tape sealing.

The amount of vertical movement of the taping stage head using the secondary measurement is preferably limited to a small height variation or change. This is preferred to keep operational speeds higher. The use of side contacts and at least one transducer for measuring or indicating case width provides more accurate information than a beam array. This in turn helps to reduce the vertical adjustment needed by the taping stage head because the box open and expected closed heights are more accurately modeled.

The secondary height detector contact can further optionally be provided with contact rollers 429 which are rotatably mounted upon connection arm 425 and a complementary part along the opposing side of contact piece 411. Rollers 429 help to reduce wear on the contact piece and provide for smoother operation. Rollers 429 also serve to compress the major flaps as they roll thereover.

Taping Stage Lateral Support Mechanisms

FIG. 3 shows in overall perspective the preferred lateral support mechanisms 440. There are two opposing lateral supports 440 which engage and support the upper sidewalls of the case being sealed. The lateral supports include movable heads which have a series of contact rollers 441 which engage the top portion of the case side walls being processed. The contact rollers are mounted to revolve about vertical rotational axes defined by mounting bolts 442. Mounting bolts 442 extend through apertures (not shown) formed in lateral support headpieces 443.

The lateral support headpieces 443 have a horizontal portion 444 which mounts the rollers 441, a chamfer part 446, and an upstanding end plate portion 447. The headpieces 443 are supported by a controllable, movable mount which is advantageously in the form of a sliding linear operator 450.

Each sliding linear operator includes a pair of over and under slide rods 451 and 452. The slide rods are connected at the distal ends thereof to the upstanding portion 447 of the headpiece 443 to move the headpieces with associated rollers 441 into proper position to laterally support the case but not squeeze the case to a degree which causes contractive distortion thereof.

Slide rods 451 and 452 are received through the operator or actuator body piece 455. Air or other pressurized fluid is applied in a controlled fashion to the body pieces and valved in such a way that the slide rods are extended and contracted in a controlled fashion. Extensions 457 provide added support for the cantilevered slide rods 451 and 452 which run above and below the extensions, respectively.

The actuator body pieces 455 are mounted to mounting arms 460. Mounting arms 460 are weldments that mount to the main transverse subframe member and also provide a mounting end plate for receiving mounting bolts 456 which extend through body pieces 455 and into the mounting arms.

Tape Applicator

FIGS. 3-5 also show a tape applicator assembly 480. Tape applicator is a commercially available tape application device. Other tape applicators may alternatively be used. The tape applicator has a supply spindle 481 which holds a spool of tape (not shown) thereon. The spindle has a disk portion 482 and is mounted on an arm 483. Adhesively faced tape plays off a spool mounted on the spindle and is trained about tensioning spindles which may vary from one tape applicator to another. The tensioning spindles direct the tape to an applicator roller 486 best shown in FIG. 5. Adjacent to the applicator roller is a tape-out detector arm 487 which senses when the unit is out of adhesive tape and stops operation until an operator can resupply the spindle 481.

The preferred tape applicator 480 also includes a press roller 489 which allows the tape to be rolled into better adhesion and allows tape to be wrapped over the edges of the case being sealed. Applicator 480 also includes a knife 488 which is used to sever the tape as needed for the tape pattern desired.

Output Stage

FIG. 1 shows that machine 100 also includes an output stage 180 which includes an exit portion of the conveyor train. The transverse flights 111 force the outgoing case 101 from the conveyor rollers 112. A final output roller 181 is mounted for free rotation to facilitate the pass off of the sealed case to another conveyor or other desired downstream piece of handling equipment. A power coupling to roller 181 may be preferred to accelerate the case slightly upon exit.

Second Embodiment Machine

General Configuration of Second Embodiment Machine

Figure 6:
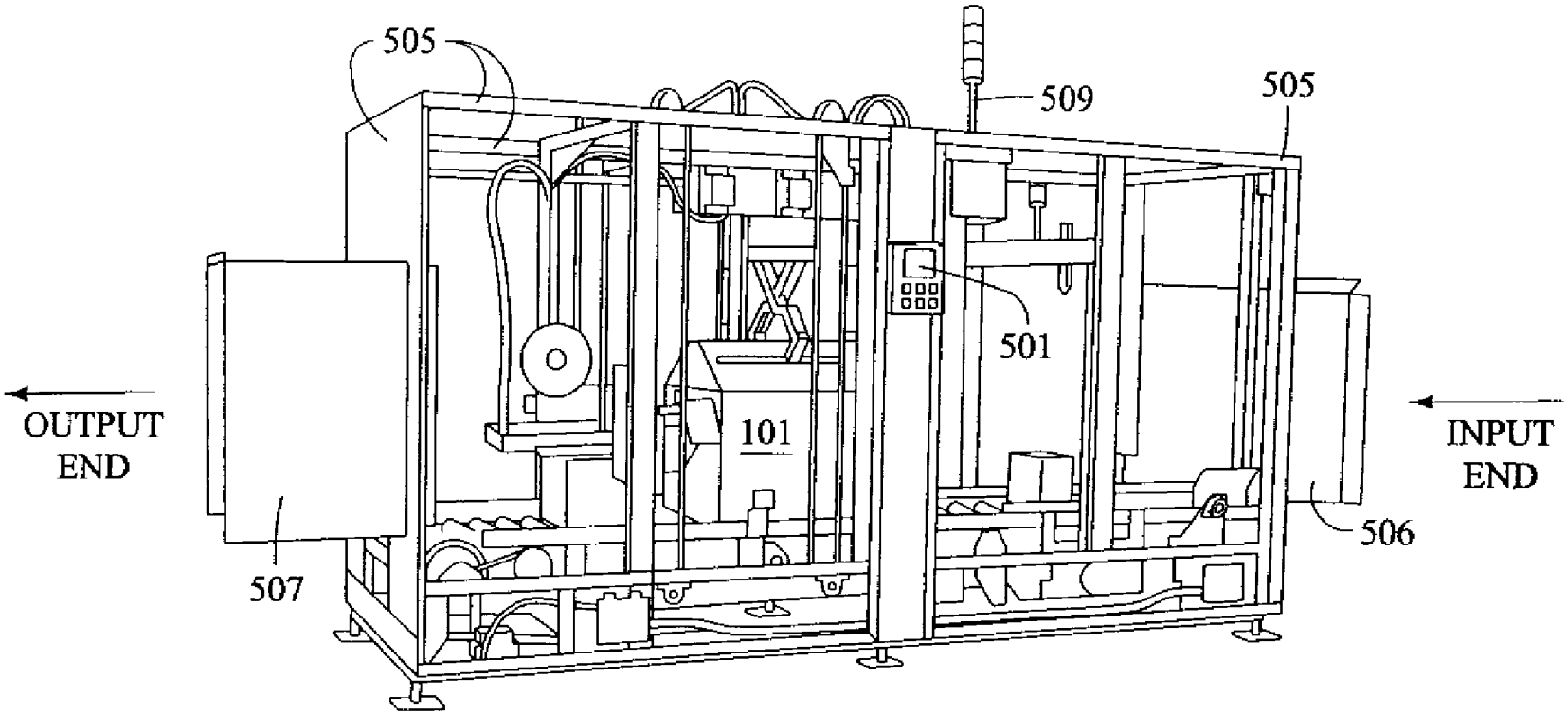
FIG. 6 is a perspective view of a second embodiment machine according to the invention.

FIGS. 6-16 show a second embodiment machine 500 in accordance with the inventions. FIG. 6 shows machine 500 is designed for commercial installation and thus has exterior operator control panel and switches 501 for use by a human operator to control startup, shutdown and various parameters of the machine's operation.

FIG. 6 also shows that machine 500 has a safety enclosure 505 which extends around the internal machinery to reduce the risks of accidents. Cases are conveyed to machine 500 and into an input cowling 506. Cases are operated upon by machine 500 in a manner similar to machine 100 and exit through an exit cowling 507. An operational alarm and warning lights can be mounted upon a warning staff assembly 509.

In many respects machine 500 is similar or the same as machine 100 described above. Where material differences exist, additional explanation is given below. Parts and features which are the same or similar to those described with regard to machine 100 are labeled with the same reference numbers and the description thereof will not be repeated but is incorporated by reference with regard to machine 500.

Framework

Figure 7:
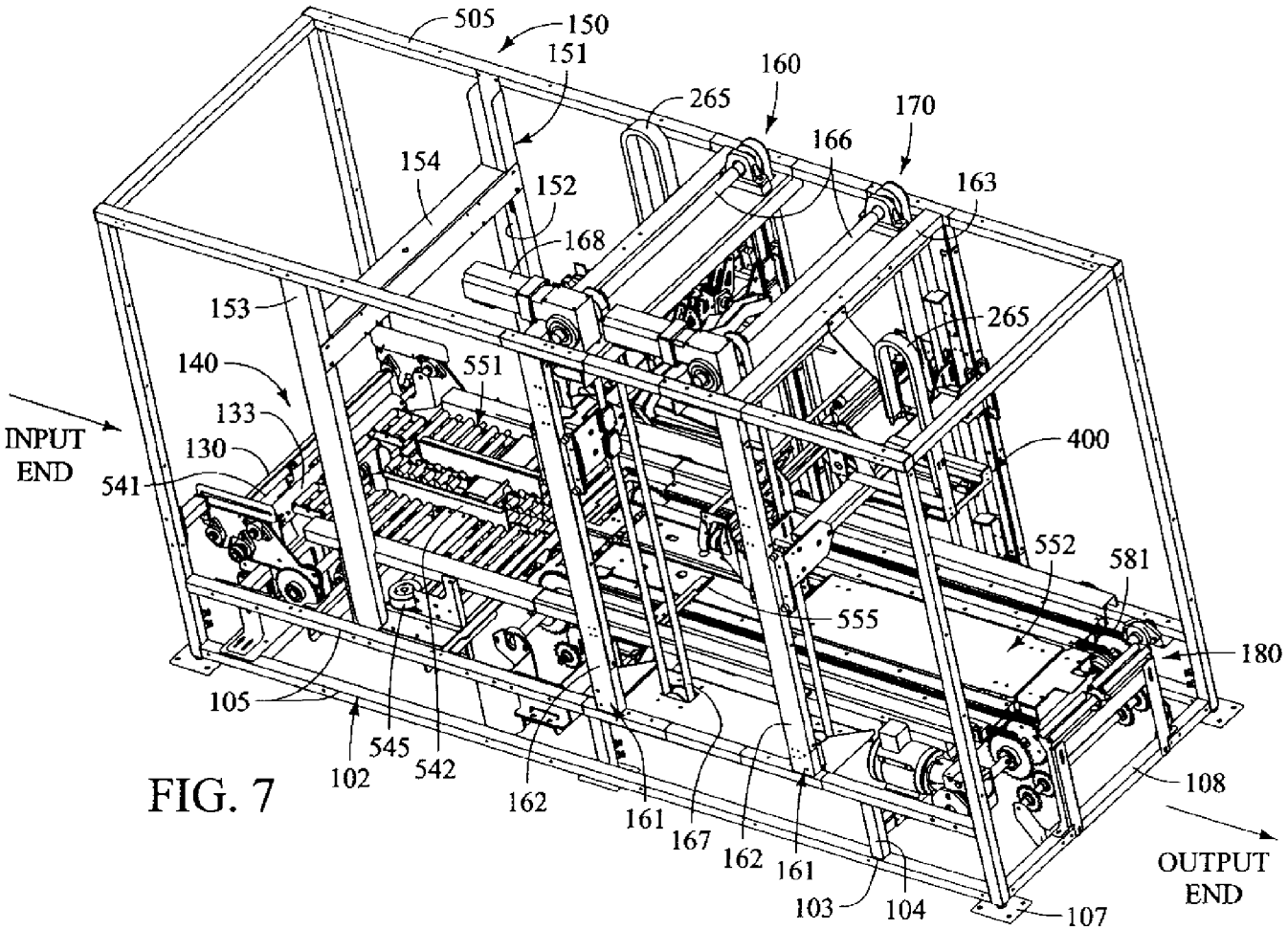
FIG. 7 is a perspective view of the machine of FIG. 6 with portions removed to better show the inner operational parts of the machine.

The framework of machine 500 is similar to that used in machine 100 and has been similarly labeled. Additional structure has been added to support the safety enclosure 505 in the form of additional supporting tubular structural members. Such also serve to stabilize other parts of machine 500. FIG. 7 shows machine 500 without most of the safety enclosure and other external features to better portray the internal machinery.

Input Receiver

The input receiver 140 has a similar configuration to machine 100 to but is modified to include a small roller 541 which is mounted with the gate assembly 130 and acts as in initial roller contact for incoming cases when the gate is operated into the retracted, down position.

Case Squaring and Centering

Figure 8:
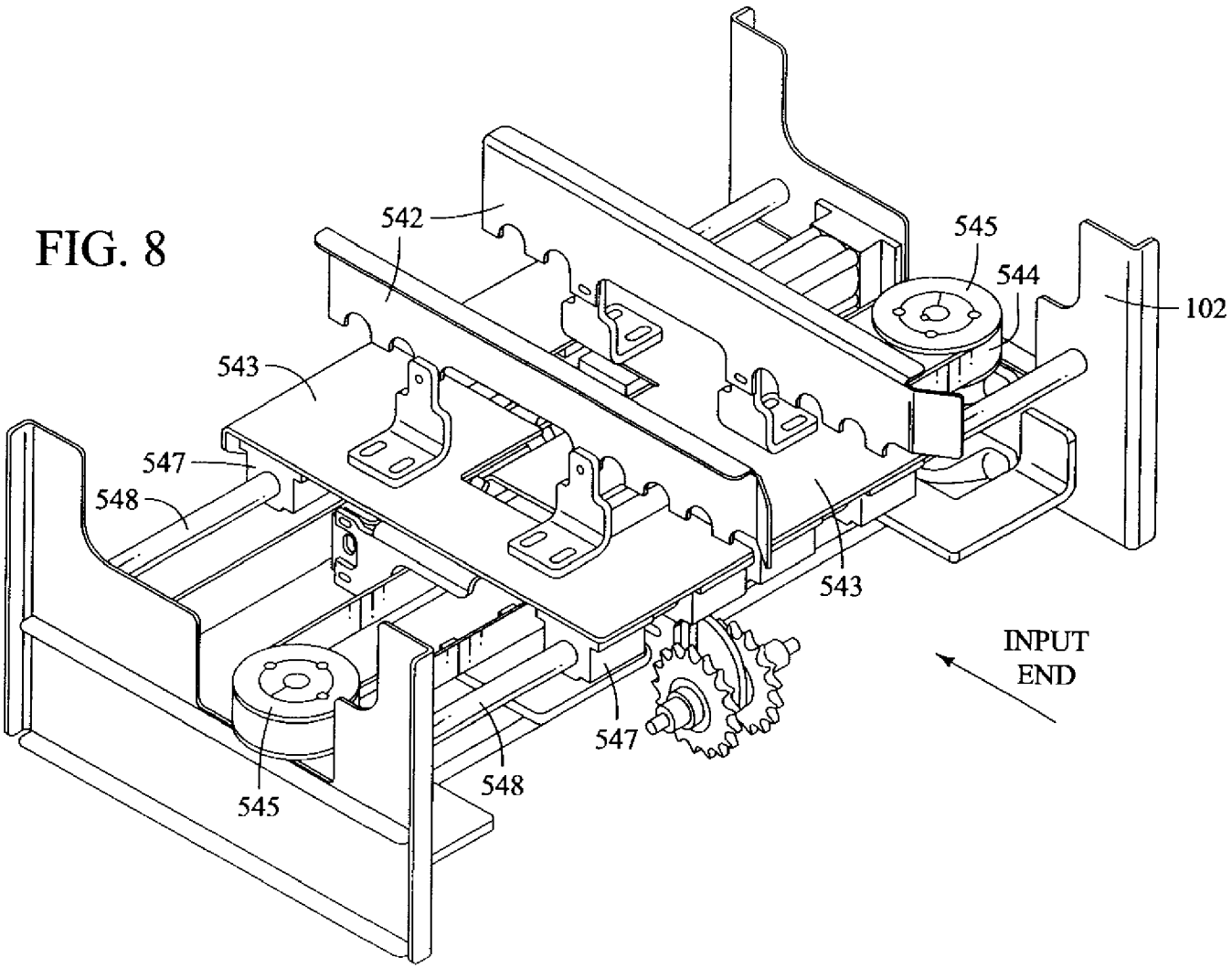
FIG. 8 is a perspective view in isolation and enlarged scale showing portions of the machine of FIG. 6 used to center and square the cases immediately after they are input into the machine.
Figure 9:
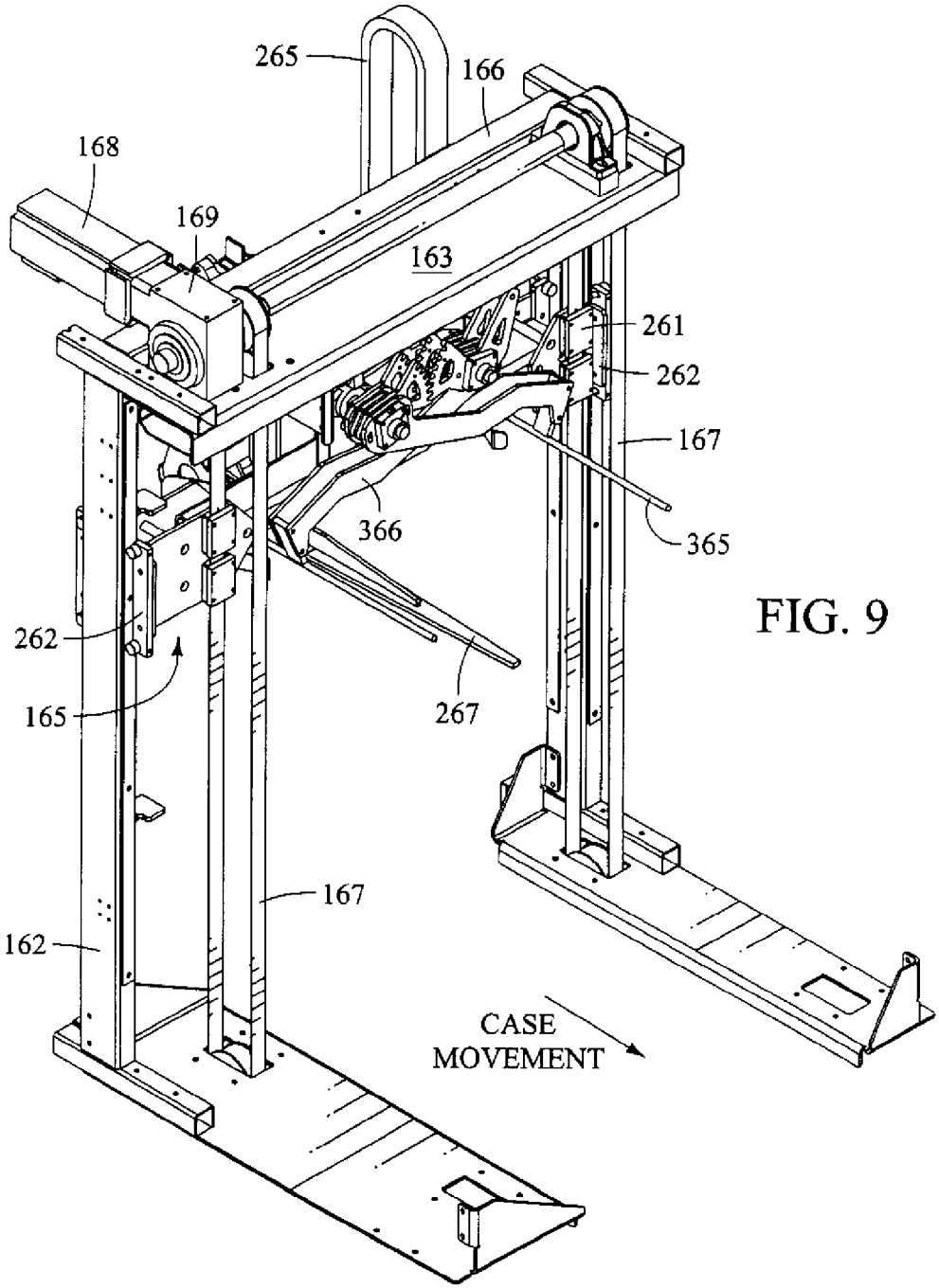
FIG. 9 is a perspective view in isolation showing parts of the case closing stage of the machine of FIG. 6.

The case squaring and centering mechanism is implemented in a construction having some differences relative to machine 100. FIG. 8 shows the construction in greater detail and enlarged. The packaging cases are centered between the centering contacts 542. The opposing centering contacts are mounted upon sliding mounts 543 which are separated along the centerline of the machine. A drive belt 544 is trained about rotatable sheaves 545 mounted on opposite sides of the framework 102.

The opposing sliding mounts 543 have linear bearings or slide blocks 547 which engage front and rear slide rods 548. The slidable mounts 543 are connected to opposite runs of the belt 544 and thus operate in equal and opposing directions.

Conveyor Train

The conveyor train of machine 500 has a different configuration than the conveyor train of machine 100. It comprises two different conveyors; a first or input conveyor 551 and a second or operational conveyor 552. Input conveyor 551 has rotating rollers 112 similar to machine 100 but with a slightly different arrangement for support of some rollers. The centering and squaring contacts 542 have semicircular cutouts along the bottom edges through which the rollers are positioned. The contacts 542 can thus move over the rollers as they are expanded and contracted relative to the centerline of the machine.

The first or input conveyor also uses a center flight conveyor which is moved by a paired chain drive which is along the centerline using chain sprockets (FIG. 8). This also is desirable for purposes of the expanding and contracting squaring and centering mechanism. The first conveyor takes the incoming cases and passes them through the measuring stage 150. The first conveyor ends about the start of the closing stage 160.

A centered and measured open case is moved by the first conveyor until a point where the second conveyor 552 can engage the case with a slide flight conveyor having contacting flights 555. The operational or second conveyor 552 takes the cases through the closing and sealing processes and then discharges the closed and sealed case through to the output stage 180. Output stage 180 has rollers 581 which allow the completed case to exit the machine 500.

Case Measuring Stage

The case measuring stage 150 of machine 500 is similar with regard to the height measuring with optical emitters and detectors arranged in opposition across the conveyor. Width measuring is done using a width detector mounted to the squaring and centering mechanism using a transducer (not shown). This can alternatively be done using an optical detector which uses image contrast information to discern the sidewall position or positions of the case side wall or walls. Alternatively, other measuring systems can be used for one or both of these measured parameters to provide height and width information to the control system.

Case Closing Stage Generally

The case closing stage 160 of machine 500 is very similar to the case closing stage 160 of machine 100. Some differences will now be noted.

Closing Stage Movable Assembly

The closing stage movable assembly 164 for machine 500 is similar to that described for machine 100 above except as otherwise noted shown in the figures.

Figure 10:
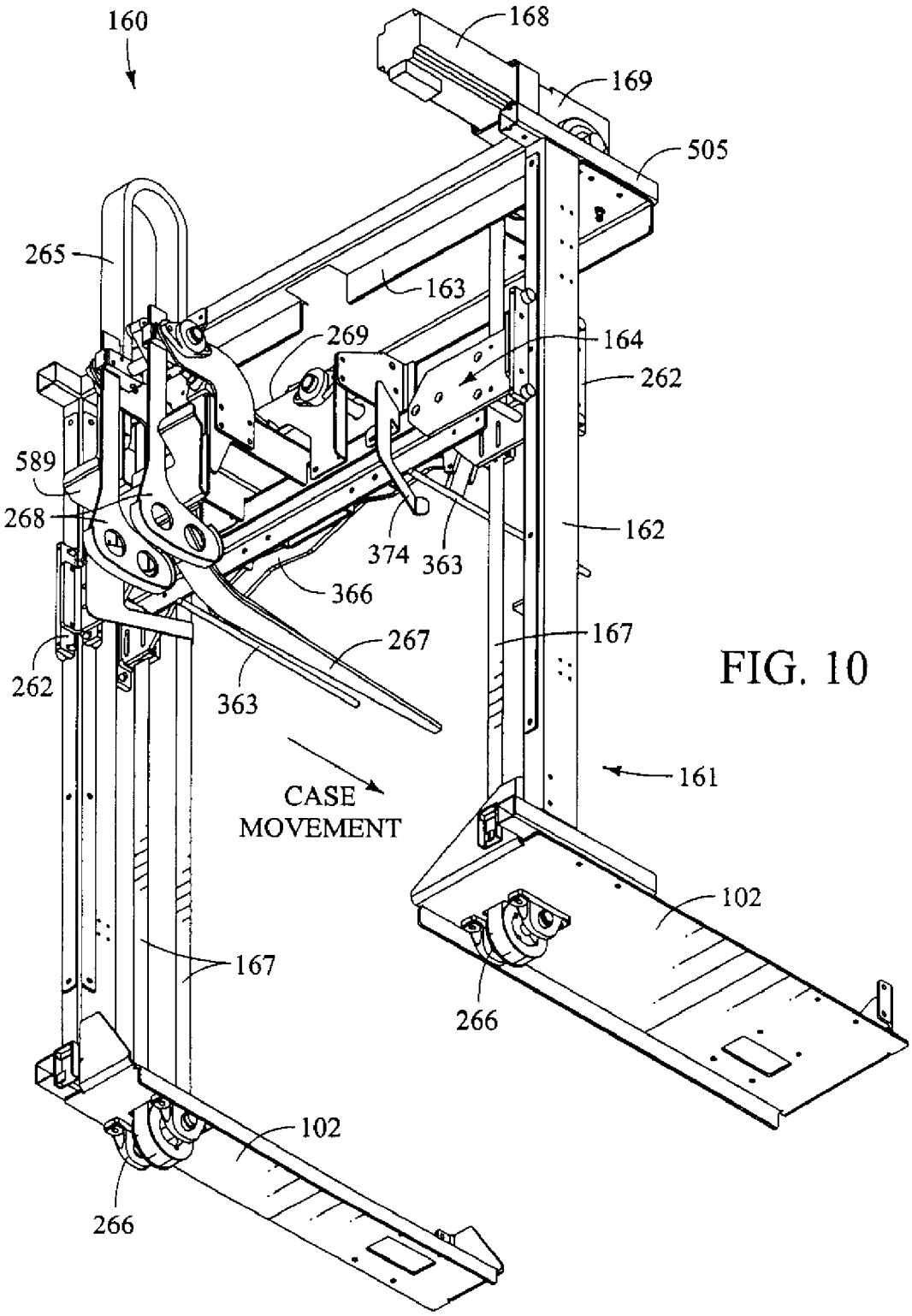
FIG. 10 is a perspective view from a below and forward or infeed viewpoint showing in isolation parts of the case closing stage of the machine 14 of FIG. 6.

FIG. 10 shows that the static front minor flap closer 267 is in the alternate form of a curved and tapered strap or tine which extends down and curves back into a flattened cantilevered section.

Rear Minor Flap Closing Mechanism

Figure 12:
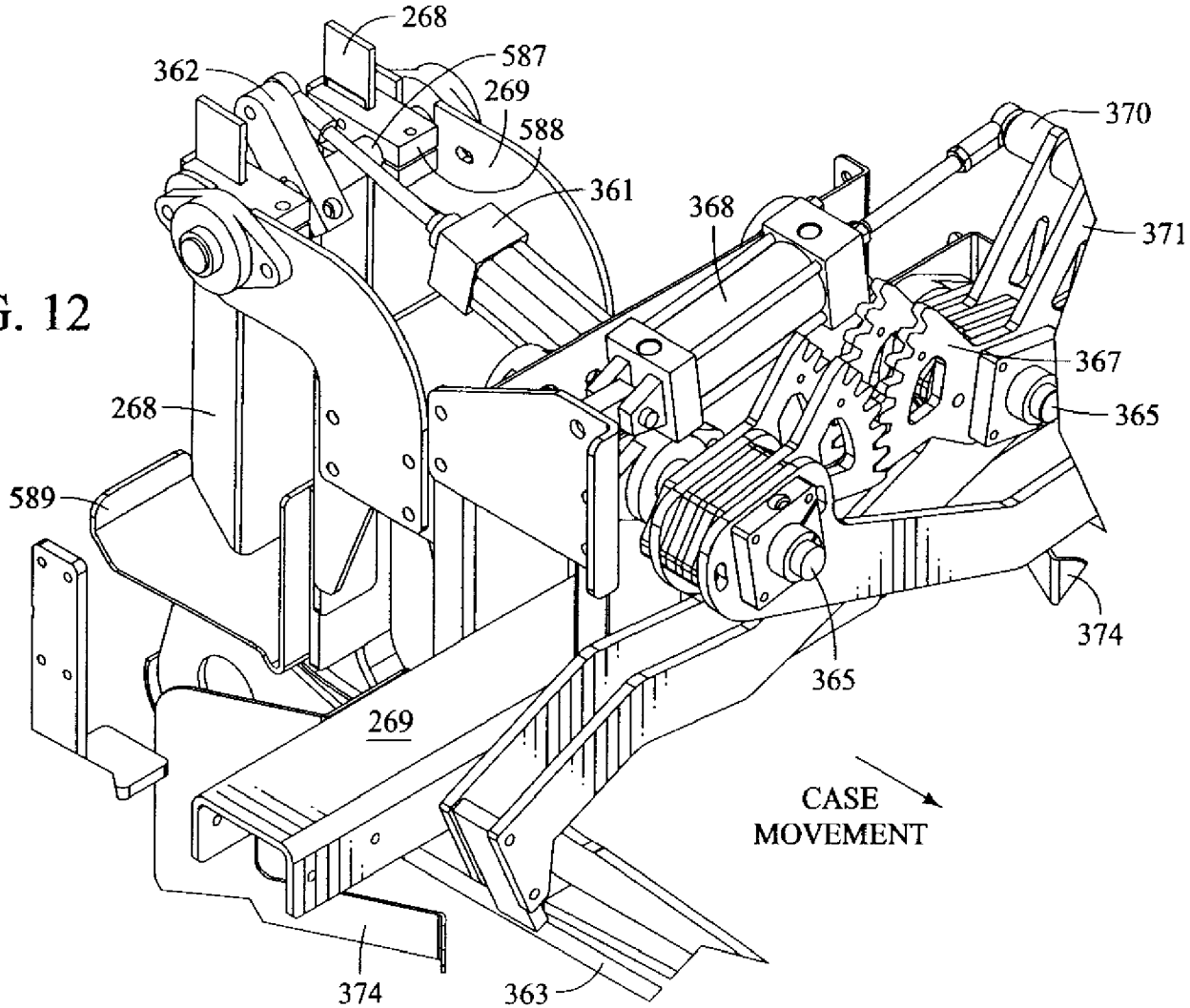
FIG. 12 is another perspective view in isolation of portions of the major flap folding mechanism forming part of the case closing stage of the machine of FIG. 6.

FIG. 12 shows an alternative preferred construction for the rear minor flap closer. In this configuration the kicking legs 268 are mounted upon shaft 587 using couplings 588. The operator connection lever arm 362 is nonrotatably connected to shaft 587 and pivotally connected to the output rod of pneumatic cylinder operator 361. The opposite end of operator 361 is pivotally connected to the movable assembly subframe 269.

FIGS. 10 and 12 also show a leading minor flap plow 589. This plow helps eliminate caving the front panel of a wide case. It provides better leverage on taller and wider minor flaps to help assure the flap bends on the fold or score line of the minor flap rather than depressing and caving the front wall of the case being contacted.

Major Flap Closing Mechanism

Figure 11:
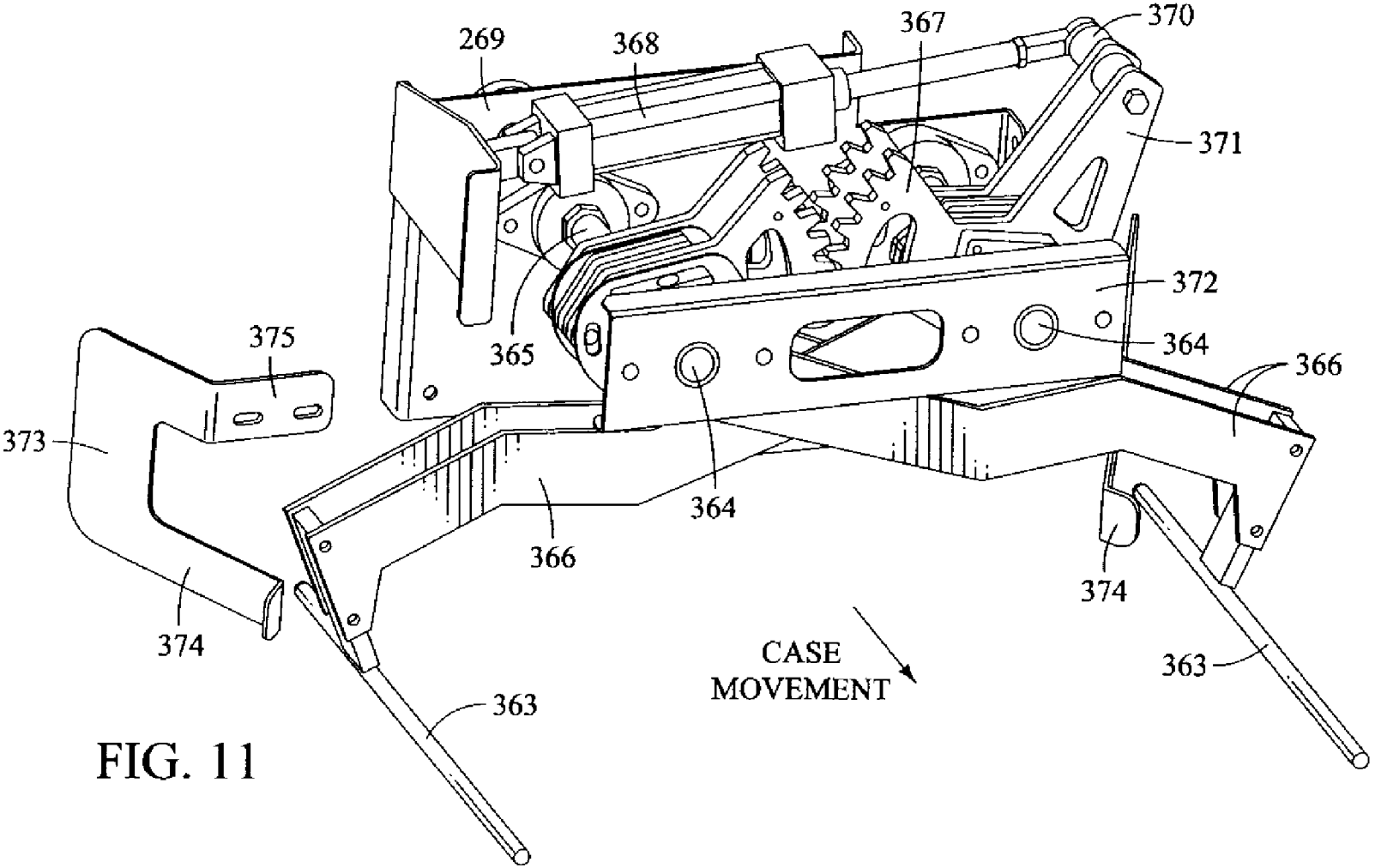
FIG. 11 is a perspective view in isolation of portions of the major flap folding mechanism forming part of the case closing stage of the machine of FIG. 6.

Another area of difference is shown in FIG. 11 for the operator 368 for the active major flap closer. In machine 500 the operator uses a single pneumatic cylinder or ram extending between a pivotal connection with subframe 269 and pivot connection 370 which connects to the gear set lever arms 371.

Taping Stage Generally

Figure 13:
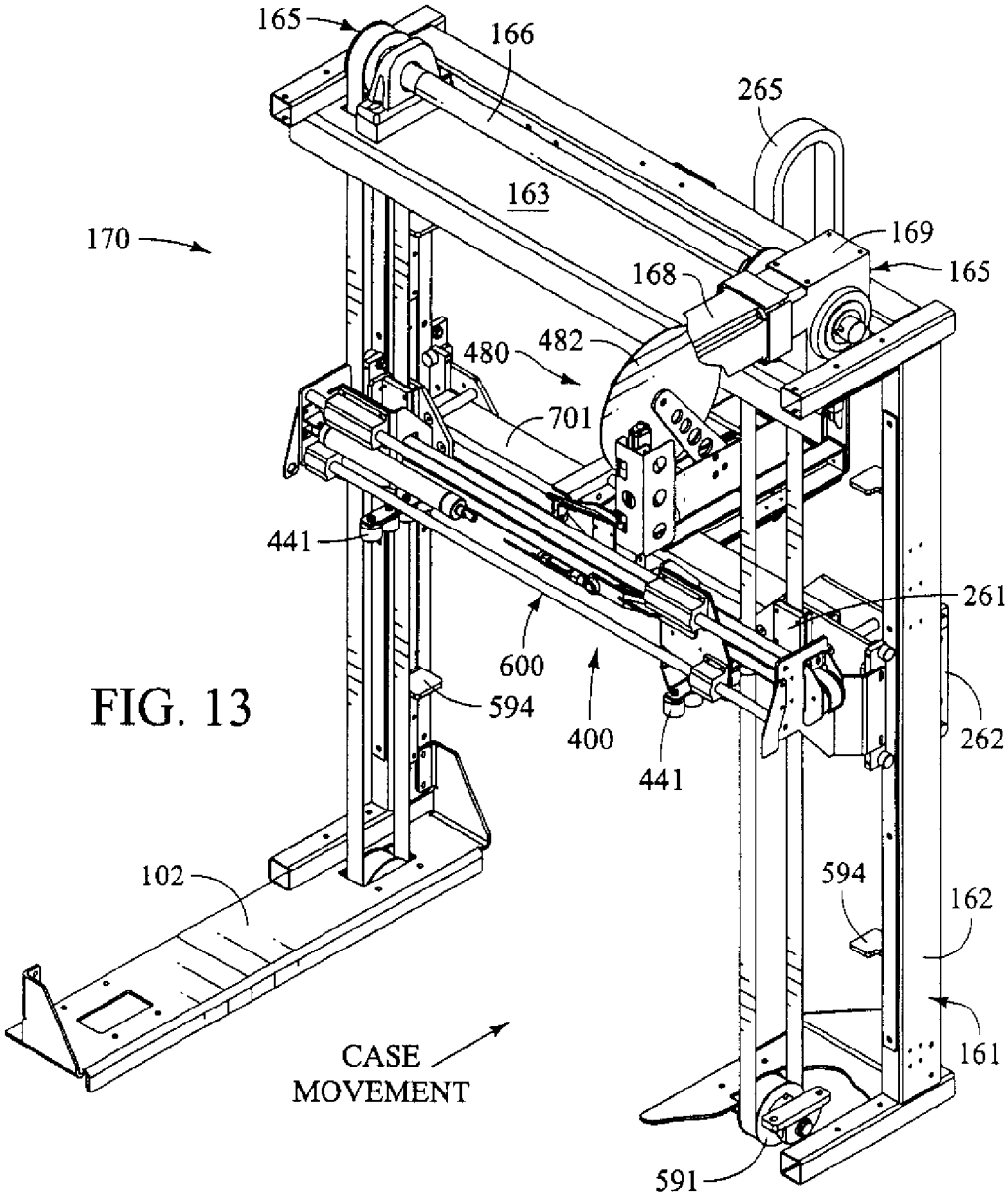
FIG. 13 is a perspective view in isolation of portions of the tape sealing stage of the machine of FIG. 6.

FIG. 13 shows the taping or sealing stage 170 as preferably constructed in machine 500. The sealing stage is similar to that used and described above in connection with machine 100. Some differences exist which will now be explained.

The lower sheaves 591 are individually supported to the framework 102 and the vertical drive belts 167 are trained around sheaves 591.

Mast 161 is preferably provided with movable assembly stops 594 along the inner sides of the mast uprights 162. These are used to limit the travel of the movable assembly within minimum and maximum heights. The stops may be adjustable and provide protection against damage in case of accidental over-travel.

The remaining portions of the mast structure and vertical drive 165 otherwise are similar and do not warrant re-description.

Taping Stage Movable Assembly

FIG. 13 shows the taping stage movable assembly 400 used in machine 500 has a main cross beam 701 (FIG. 14) which extends between the trolleys 262 that run up and down the mast 161. Cross member 701 includes a taping applicator mounting weldment 702 that is secured to beam 701. Applicator mount 702 includes a pair of side rails 703 which can be C-shaped members in opposing relationship. A front piece 704 and rear piece 705 extend between the side rails 703. A taping applicator receptacle 706 is formed within the subframe formed by pieces 703, 704 and 705.

The taping or sealing stage movable assembly is again provided with a secondary height detector subsystem and lateral support mechanisms that will be detailed below.

Taping Stage Secondary Height Detection Mechanism

Figure 14:
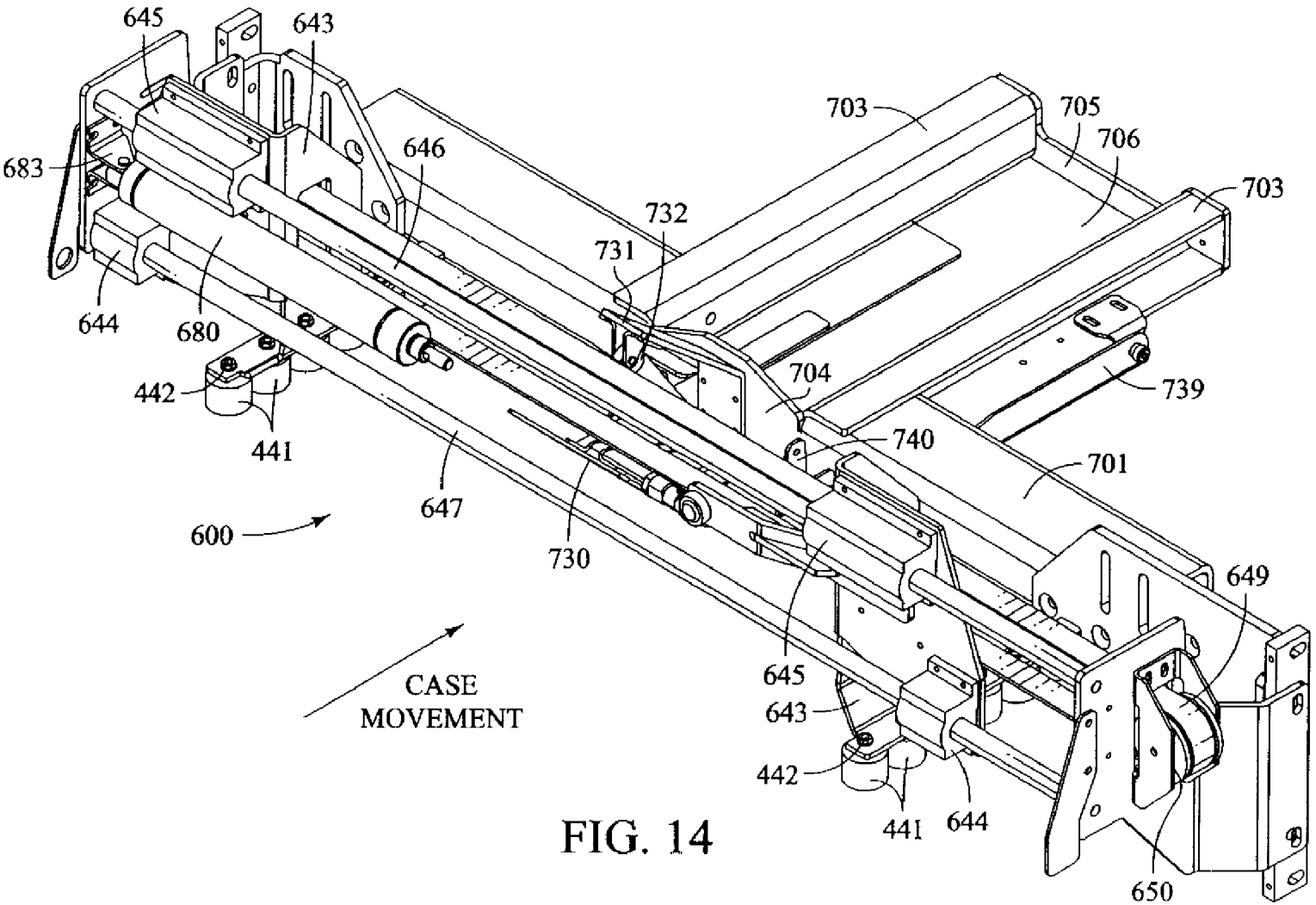
FIG. 14 is a perspective view in isolation and enlarged scale of portions of the sealing stage used to provide lateral support in the machine of FIG. 6.
Figure 15:
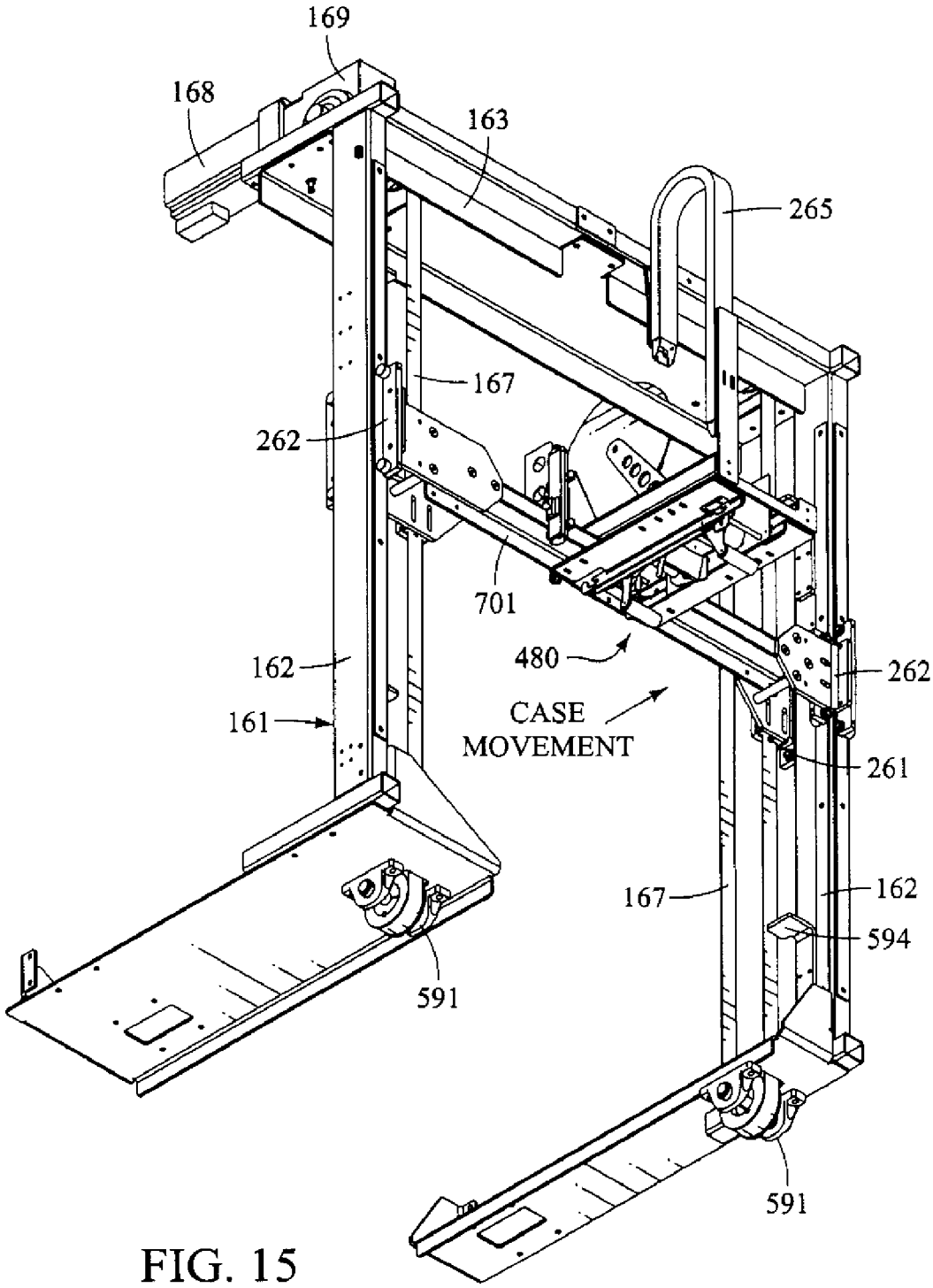
FIG. 15 is a perspective view from a forward underside viewpoint of isolated portions of the tape sealing stage of the machine of FIG. 6.

Machine 500 has a secondary case height detection mechanism for detecting with greater accuracy the height of the cases as they are fed into the tape sealing stage. FIG. 14 shows that the secondary height detection mechanism includes a contact plate 730 which is connected to the movable subframe at a spring mount arm 731. The spring mount arm 731 is provided with a pivot connection 732 that is linked with the contact plate 730.

Figure 16:
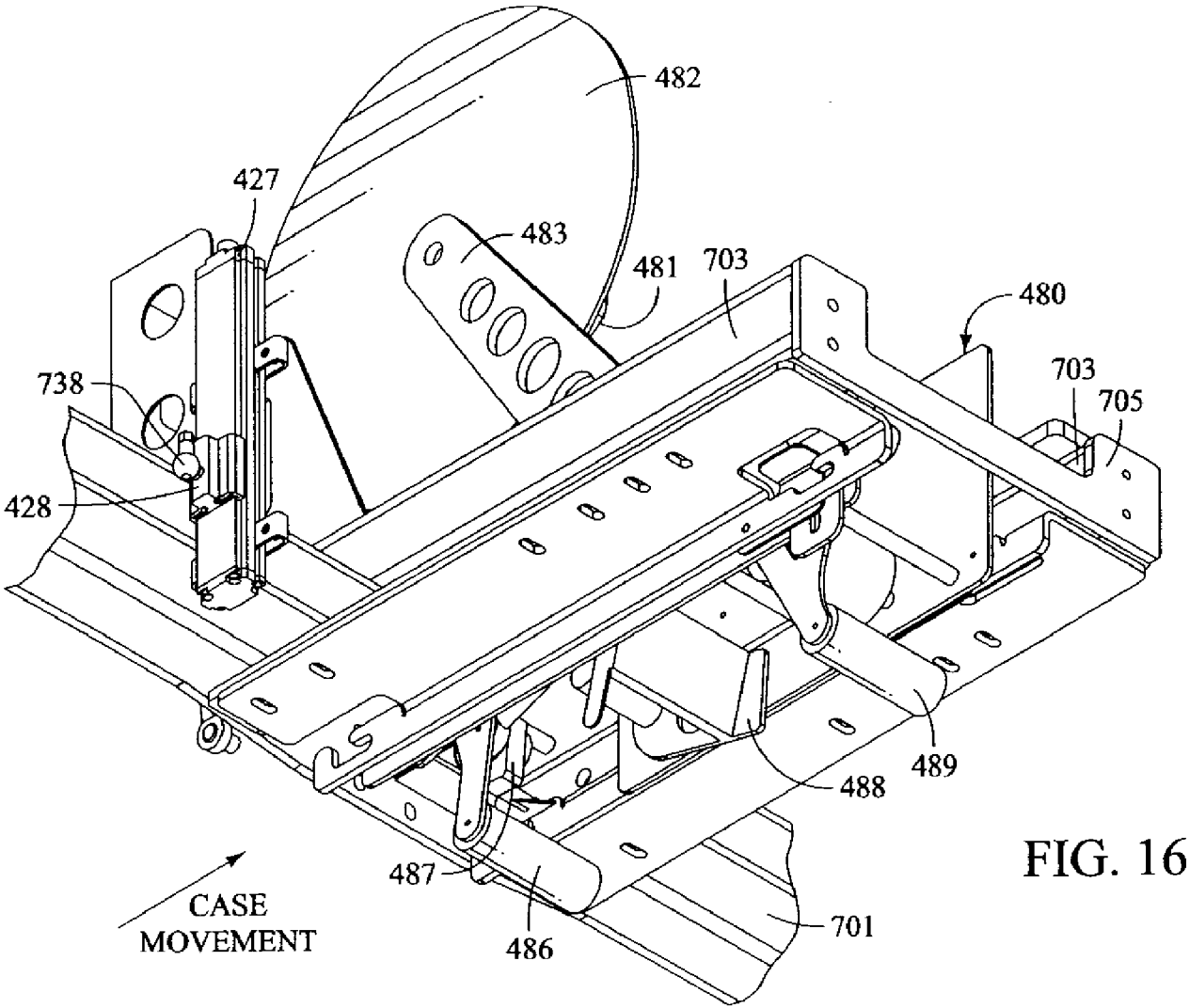
FIG. 16 is a perspective view from a forward underside viewpoint and in enlarged scale of the tape application mechanism forming part of the tape sealing stage of the machine of FIG. 6.

FIG. 16 shows the detector linear transducer 427 with movable slide 428. Slide 428 has a ball fitting 738 which is connected by a link (not shown) to the contact plate 730.

FIG. 14 shows a pivotal mounting extension 739 that is part of the contact plate 730. Contact plate 730 is pivotally connected to the side rails 703 and extends toward the oncoming cases. A connection extension 740 extends upward beneath the transducer 428 and links to the ball fitting 738 by a connection link (not shown). The detected secondary case height measurement from transducer 428 is used to control the servomotor driving vertical positioning of the sealing stage movable assembly to optimally position the height of the taping applicator 480.

Taping Stage Lateral Support Mechanisms

FIG. 14 shows a revised preferred form of lateral support mechanism 600 used on machine 500. Lateral support mechanism 600 includes a series of lateral engagement rollers 441 mounted for rotation about vertical or upstanding axes of rotation. The rollers are mounted upon forward arms of the lateral support end pieces 643. Lateral support end pieces 643 are also connected to lower and upper slide blocks or linear bearings 644 and 645. Linear bearings 644 and 645 slide upon lower and upper guide rods 647 and 646, respectively.

FIG. 14 also shows a coordination mechanism for coordinating the lateral support end pieces 643 so that each slides inwardly and outward by a coordinated amount to engaged the top edges of a closed case in a balanced fashion. As shown, this is accomplished using a coordination belt 649. The belt is trained about two supporting sheaves 650 which are mounted to the movable assembly subframe in a manner allowing rotation of the sheaves. The opposing lateral support end pieces 643 are coupled by couplings (not illustrated) to respective different runs of belt 649 thus causing the sliding lateral support assemblies to move coordinated or equal amounts in contraction or expansion. The amount of movement is limited in contraction by means of low pressure on the operator. This is advantageously a low pressure air operator that stops when contact is made against the case. Actuation timing may be adjusted for the measured width of the case. For example, narrow cases cause the actuation to be initiated earlier and wider cases initiated later.

Movement of the lateral support end pieces is accomplished using a lateral support operator 680 which is advantageously a pneumatic cylinder operator having an output rod 681 which extends across and is pivotally coupled with the lateral support end piece 643 shown on the right in FIG. 14. The opposite end of the operator is pivotally connected at pivot joint 683 to the movable assembly subframe at the left in FIG. 14. Belt 649 transfers power to the other lateral support end piece.

The rollers 441 apply distributed force along the upper outside side walls of the case being sealed by the tape applicator 480. This maintains the case in proper shape for taping.

Tape Applicators

A commercially available tape applicator 480 is installed in tape applicator receptacle 706 (FIG. 14), as shown in FIG. 16. Parts of applicator 480 are numbered as for machine 100 described hereinabove.

It should further be appreciated that the machines 100 and 500 may be provided with tape applicators for taping the bottom of the cases 101. This is most advantageously done using a bottom tape applicator (not shown) which applies the adhesively faced tape as the case are also taped at the top of the case. The use of the split flight second conveyor allows the tape applicator to be mounted between the two flight paths and thus perform the taping operation.

Control System

The control system of machines 100 and 500 are similar and will now be explained in sufficient detail to enable the preferred modes of, the invention to be constructed. The operator controls 501 include start and stop control keys to start and stop operation of the machine. There is also a visual display that may be used to check various system parameters and to reprogram specifics of the operation. This can be done using a touch screen display or by including additional key switches.

The control system uses a programmable logic controller which is suitably programmed to provide the desired operation described herein or other suitable operational routines. The programmable controller or controller receives information from encoders connected to the conveyor or conveyors so that the position or positions of the flights forming parts of the conveyor or conveyors are known with particularity to the controller.

The controller is also connected to the servomotors used to position the closing stage operator and taping stage operator. Such a servomotors have internal encoders that provide positioning signals that indicate after calibration the positions of the respective movable assemblies of the closing and taping stages.

The controller also receives information from the measuring stage indicative of the primary measurements for the width and height of the case or cases being processed on a case by case basis. After the measurements are made and sent to the controller the controller adjusts the height of the closing stage according to a suitable algorithm which has been found appropriate for the particular machine and range of case sizes allowed.

The controller knows the position of each case by the encoded location of the conveyor flights and then causes the kicker to operate by opening a pneumatic control valve supplying the kicker operator with pressure. Thereafter the active major flap closer is operated by supplying pneumatic or other activating signal to the major flap closer operator and thus causing the swing arms to be coordinately displaced downward and inward to force the major flaps of the case into a closed or near closed condition. The case may be slowed or stopped or maintained at a desired speed by controlling the conveyor drive motor and using the conveyor encoder output information to indicate both the position and speed of the conveyor flights which are known with accuracy to the controller due to set up and calibration prior to normal operation.

The secondary height detector further is connected to provide a signal indicating secondary measured height of the closed case. The difference between the taping stage movable assembly height and the desired height are thus adjusted by having the controller drive the taping stage drive. The taping stage drive is preferably set slightly high so the final, secondary movement is downward. Movement is provided as needed to properly position the elevation of the taping stage movable assembly and tape applicator so that the adhesively faced tape is properly and optimally rolled onto the surface of the case and over the major flap joint.

Methods and Operation

Methods and Operation Generally

Various aspects of the methods according to the invention and operational features and aspects have already been described hereinabove. The following is additional description of preferred methodologies according to the invention along with associated aspects and advantages.

The invention and technology described herein includes various forms of methods of the invention. Such methods may include one or more of the following methods or aspects either alone or in combination with one or more of the other methods and aspects described.

Cases Supplied

The methods involve supplying a case to a case handling machine such as machines 100, 500 or others according to the inventions. The case is preferably supplied in an open condition for the preferred combined closing and tape sealing machines. In other alternatives, the case may be supplied already closed without the need for performing the closing processes described herein.

Cases being handled in accordance with the invention may have the bottom flaps sealed or unsealed. If sealed there is no need for an optional bottom tape applicator (not shown). If unsealed then a bottom tape applicator may alternatively be included in machine 500.

Case Input

Machines 100 and 500 preferably act on incoming cases by first lowering the control gate 130 to allow the cases to be pushed into the machine. This is done usually by pressure applied by the infeeding conveyor (not shown) which is upstream of the input end of the machines. The inputting of cases also preferably involves engaging the cases with one or more driven support rollers which perform by accelerating the cases from their queued position at the control gate 130. The cases are accelerated and perform by moving into the receiver stage of the machines.

In the receiver stage of the machines the cases are in position to be properly oriented or aligned, which may be oriented in a direction approximately aligned with the direction of movement of the conveyor or conveyors forming the conveyor train. This is advantageously done by simultaneously squaring and centering the cases on the conveyor using the structures described hereinabove.

Methods for Primary Measuring of Case Size

The methods according hereto also include at least one primary measuring step. The primary measuring preferably includes both measuring or detecting the width of the incoming case and measuring the height of the incoming case. The measuring of the width is advantageously accomplished by detecting the position of the squaring and centering mechanism and the resulting measurements are communicated to the central controller for use in subsequent operation of the machines.

Measuring or detecting the open height of the incoming open cases is one step preferably included in the preferred processes. This may be accomplished using a preferred optical beam detection system described above. The optical beam detection system determines the height of the case by indicating the top of at least one of the major flaps in the open condition. This is usually done with the incoming case in an open condition with both top flaps open and upstanding. However, it is not necessary for both flaps to be open. The major flaps cannot be outside the range of the major flap closers.

Methods for Closing Cases

Preferred methods according to the invention also include methods for closing the case where open cases are being input. The closing of cases may first desirably employ a front minor flap closer which is advantageously a static element or tine or tines which are angled to direct the flap inward of the case as the case moves further into the machine.

The methods may also employ one or more rear minor flap closers for closing the rear minor flap. As shown, this step or steps includes using a kicker which kicks the rear minor flap into the case as the case is moving further into the machine. This kicking action is coordinated with the position of the case which is determined by the encoded position of the conveyor or conveyors used to move the cases through the machines.

The rear minor flap closer, such as the kicker shown, is preferably operated in a manner which adjusts for size of the case. More particularly, such flap closer may operate according to the measured major flap height (assuming the minor flap height is similar to the major flap height). The smaller the flap height, the later the closer operates in relationship to the conveyor flight position. The larger the flap height, the earlier the closer operates in relationship to the conveyor flight position. This adjusting of the minor flap closer timing is important in providing a wider range of case sizes to be accommodated on the same machine.

The minor flap kicker actuates in timed relation to the flight conveyor. It in some forms of the invention may function in a particularized manner for specific cases or ranges of cases. This may be a function of the measured height of the case or cases being processed.

Methods according to the invention also preferably include closing the side or major flaps. This is advantageously done using an active major flap closer, such as described above. The active major flap closer is used after being adjusted to a desired height relative to the particular case being closed. In general the active major flap closer uses information obtained in the primary measuring step, in particular both the height and width information which helps to determine the proper elevational setting for the closer. The adjusting is done so that the swing of the contacts extends downward to an elevation slightly or somewhat above the closed height of the case. The proper height will vary based on both the unclosed height and the width of the case, because the width of the major flaps is of importance in setting the elevation of the major flap closer. This is true since the closed height of the case is equal to the unclosed height less one-half the width, this is determined from the primary measuring step. This is preferably accomplished by mounting the major and minor flap closing mechanisms on the same carriage, thus eliminating the need for independent height adjustment.

The major flap closer performs by pivoting opposing crossed swing arms which are pivotally connected along opposing sides of a centerline of a case being closed using swing arm contacts which are on opposite sides of the case centerline from the respective swing arm pivots associated therewith. This provides a longer swing arm radius which is flatter across the middle section of the case being closed. The geometry preferably is arranged so that the closer engages the flaps in the upper half thereof. This improves fold of the flaps.

The major flap closer also preferably performs by coordinating the opposing crossed swing arms. The coordinating may be done in a number of ways. Preferably, the swing arms are mechanically connected to move in opposite directions by equal angular arcs. This is advantageously done using coupling gear sets which cause the proximate ends of the swing arms, near the pivots, to be positively geared together to provide coordinated pivoting action moving in angular arcs which are complementary and opposite in direction of swing. The complementary, opposite arcs are most preferably coordinated so that the contact rods are kept at the same approximate elevation relative to the The major flap folders have been found advantageous over prior static plow designs. Static plow major flap folders tend to skew a case on the conveyor. This requires a centering mechanism. The active major flap folders described herein do not skew cases appreciably so no such centering is required.

Methods for Secondary Measurement of Case Height

Methods according to some forms of the invention advantageously employ a secondary case height measuring step wherein the height of the case after closure is measured. This allows the taping stage to be initially set or adjusted at the primary height and then secondarily adjusted a minor amount a after the secondary height measurement is taken.

The secondary measuring step is performed at or immediately after the major flaps are closed. As shown this is advantageously accomplished by contacting the closed case with a contact piece that has a detector associated therewith. The detector has the ability to measure the closed case height with sufficient accuracy and speed to allow the taping stage drive mechanism to be moved as needed to bring the taping stage movable assembly to a desired set point elevation relative to the measured height of the closed case.

The primary measuring step is not indicative of the thickness of the corrugated paperboard. Thus the secondary measuring allows refined height operation.

In preferred versions of the invention the primary measurement height leads to a positioning of the taping stage movable assembly which is at or very near the expected closed height of the case by calculating the expected height as equal to the open case height less about one-half the width of the case. The taping stage movable assembly can be set slightly above or below in addition to being set at the expected closed case height. Most preferably, the height is set above by a small amount to prevent jamming of a case. In some forms of the invention the taping stage movable assembly is adjusted in height so that a detecting contact is set to move slightly upward when the case moves against the detecting contact and causes the detecting contact to generate a signal indicating contact of the case with the detecting contact. The taping stage drive assembly then responds by quickly moving the taping stage movable assembly as needed to bring the taping applicator to the desired elevation. The contact also applies some compressive force to the case joint being sealed.

The secondary height measuring is advantageously done from the movable assembly of the taping stage because the relative difference in height between the taping stage movable assembly and the closed case are most immediately in relationship to each other during this process.

The secondary detector may be provided with suitable structures, such as explained above, that perform by dampening the dynamic response of the secondary height detector to a degree which provides good measurement and output of the measured secondary height. This can be provided by having a pneumatic or other compressed gas damper that is connected between the contact and the subframe of the taping stage movable assembly. By adjusting the pressure of air or other gas supplied to the damping device or devices used, the dynamic response of the detector can be adjusted. This may be useful to prevent hopping or bouncing of the detector when the closed case engages the detector at the speed of the conveyor.

Methods for Laterally Supporting Case

Methods performed according to the invention also preferably include laterally supporting the case. This is advantageously done immediately after the case engages the secondary height contact detector. It is also advantageously done before the case contacts the taping applicator or other parts of the taping stage movable assembly. These relationships are desirable to prevent distortion of the case which might otherwise occur due to contact by the detector or taping applicator without lateral support. In desired operation the compressing by the lateral supports occurs approximately as the leading edge arrives at the lateral support. This occurs at different flight positions for differing lengths of cases. The measured width of the case is used to control timing of the extension of the lateral supports.

The lateral supporting action is preferably done by extending a movable contact until contact with the case is achieved. This is preferably done using low pressure operators which are stopped by the case.

The lateral supporting action is also preferably done by engaging the upper side walls of the case. This is advantageously done by engaging these surfaces of the case using one or more rotatable rollers which may roll along and apply force to the upper portions of the case, immediately below the major flap score or fold lines.

The lateral supporting action is also facilitated by using a pneumatically controlled cylinder which provides compressed gas cushioning and equalization of pressure or force to the case surface. This reduces potential damage to the case as compared to fixed slides mechanically extended.

The lateral supporting action also serves to counteract the forces applied by the taping applicator which bear upon the major flap joint at the center of the case top surface in the typical configuration.

Methods for Applying Sealing Tape

The methods for applying the sealing tape are advantageously adapted to present the tape at the proper elevation for rolling of the adhesively faced tape against the top surface of the case being sealed. Even more preferably, the taping occurs in a manner which provides depending segments along the leading and trailing edges of the case to thereby seal the major flaps down to the front and rear walls of the case and better secure the case in a closed and sealed condition. This is done using commercially available tape applicators and the specific functions of these applicators may vary depending upon the brand and model selected.

The applied tape is preferably rolled a second time to provide better adhesion and this is done using the tape applicator in the machines as shown and described above.

The tape applying process also includes cutting the tape at a desired point in the application process.

The applying of sealing tape to a case is desirably done so that a segment of tape is overlapped onto the leading and trailing end walls of the case to secure the major flaps down to the case front and rear walls, respectively.

Exiting or Discharge of Cases

Cases that have been tape sealed are further conveyed by the conveyor train toward the exit end of the machine. The machines preferably have exiting rollers which are driven at a suitable rotational speed to function by accelerating the cases onto a related piece of equipment, such as a storage area or downstream conveyor not forming part of these inventions.

Further Aspects and Features

The above description has set out various features and aspects of the invention and the preferred embodiments thereof. Such aspects and features may further be defined according to the following claims which may individually or in various combinations help to define the invention.

Interpretation Note

The invention has been described in language directed to the current embodiments shown and described with regard to various structural and methodological features. The scope of protection as defined by the claims is not intended to be necessarily limited to the specific features shown and described. Other forms and equivalents for implementing the inventions can be made without departing from the scope of concepts properly protected hereby.

What is claimed is:

1. An apparatus for closing and sealing cases of different sizes, comprising:

an input stage having an input gate, the input gate having a first position to prevent passage of an open case and a second position to allow passage of the open case;

a case measuring stage, to receive the open case from the input stage and to measure a height and a width of the open case, wherein a calculated closed case height is derived from the measuring of the height and width of the open case;

a case closing stage, having a height set according the calculated closed case height, to receive the measured open case from the case measuring stage and to close flaps on the open case and to thereby produce a closed case, wherein the case closing stage comprises a dynamic closing mechanism comprising:

left and right contact bars, moved by left and right swing arms, respectively, the left swing arm and right swing arm pivoting about a left arm pivot axis and a right arm pivot axis, respectively, wherein the left arm pivot axis is on a right side of a centerline of the open case and the right arm pivot axis is on a left side of the centerline, and wherein the left and right swing arms are in a crossed relationship;

left and right gear sets, extending from the left and right swing arms, respectively, the left and right gear sets meshing together to result in synchronous movement of the left and right swing arms; and a lever arm, extending from one of the left and right swing arms, the lever arm driven by a power source;

a case sealing stage, vertically movable to an initial height set according to the calculated closed case height before the closed case arrives from the case closing stage, to seal the closed case, and to thereby produce a sealed case;

a secondary height detection system, within the case sealing stage, to measure a height of the closed case and to direct the case sealing stage to move from the initial height to a subsequent height, the subsequent height determined according to the measured height of the closed case; and an output stage to accelerate the sealed case upon departure from the case sealing stage.

2. The apparatus of claim 1, wherein the secondary height detection system includes a secondary height contact, the secondary height contact movable by physical contact with the closed case and configured to determine height of the closed case from the physical contact with the closed case.

3. The apparatus of claim 2, wherein the secondary height detection system additionally includes a damper, to damp motion of the secondary height contact upon physical contact with the closed case.

4. The apparatus of claim 1, wherein the secondary height detection system includes a secondary height contact configured for movement in vertical directions in response to input from the case measuring stage and in response to physical contact with the closed case.

5. The apparatus of claim 1, additionally comprising contact rollers to engage upper portions of opposed vertically-oriented sidewalls of the closed case, the contact rollers configured for adjustable horizontal movement to provide adjustable pressure to the upper portions of the opposed vertically-oriented sidewalls, wherein the adjustable horizontal movement provides lateral support to the closed case as the closed case is measured by the secondary height detection system.

6. The apparatus of claim 1, wherein a position of the input gate is pulled downwardly by an actuator to allow advancement of the open case, and wherein a driven infeed roller is configured to propel the open case to a location within the input stage that allows a transverse flight element to push against the open case.

7. An apparatus for closing and sealing cases of different sizes, comprising:

a conveyor train, comprising a first conveyor and a second conveyor;

a case measuring stage, through which the first conveyor is deployed, the case measuring stage configured to measure a height and a width of an open case, wherein a calculated closed case height is derived from the measuring of the height and width of the open case;

a case closing stage having a height set according input from the case measuring stage, the case closing stage configured to receive the measured open case from the case measuring stage and to close flaps on the open case and to thereby produce a closed case, wherein the case closing stage comprises a dynamic closing mechanism comprising:

left and right contact bars, moved by left and right swing arms, respectively, the left swing arm and right swing arm pivoting about a left arm pivot axis and a right arm pivot axis, respectively, wherein the left arm pivot axis is on a right side of a centerline of the open case and the right arm pivot axis is on a left side of the centerline, and wherein the left and right swing arms are in a crossed relationship;

left and right gear sets, extending from the left and right swing arms, respectively, the left and right gear sets meshing together to result in synchronous movement of the left and right swing arms; and a lever arm, extending from one of the left and right swing arms, the lever arm driven by a power source;

a case sealing stage, vertically movable to an initial height set according to the calculated closed case height before the closed case arrives from the case closing stage, the case sealing stage configured to seal the closed case, and to thereby produce a sealed case, wherein the second conveyor is deployed through the case closing stage and the case sealing stage;

a secondary height detection system, within the case sealing stage, to measure a height of the closed case and to direct the case sealing stage to move from the initial height to a subsequent height, the subsequent height determined by operation of a secondary height contact, the secondary height contact moved initially in a vertical direction based on movement of the case sealing stage and moved subsequently in a vertical direction based on contact with the closed case; and an output stage to accelerate the sealed case upon departure from the case sealing stage.

8. The apparatus of claim 7, wherein the secondary height detection system includes a damper, to damp motion of the secondary height contact upon contact with the closed case.

9. The apparatus of claim 7, additionally comprising contact rollers to engage upper portions of opposed vertically-oriented sidewalls of the closed case, the contact rollers configured for adjustable horizontal movement to adjust to differing case sizes and to provide adjustable pressure to the upper portions of the vertically-oriented sidewalls, wherein the adjustable horizontal movement provides lateral support to the closed case as the closed case is measured by the secondary height detection system.

10. The apparatus of claim 7, additionally comprising an input gate to regulate movement of the open case, the input gate moveable between open and closed positions by an actuator, wherein a driven infeed roller is configured to propel the open case to a location onto the first conveyor at a location at which a transverse flight element contacts the open case.

11. An apparatus for closing and sealing cases of different sizes, comprising:

a conveyor train, comprising a first conveyor and a second conveyor;

a case measuring stage, through which the first conveyor is deployed, to measure a height and a width of an open case, wherein a calculated closed case height is derived from the measuring of the height and width of the open case;

a case closing stage, having an height set according input from the case measuring stage, to receive the measured open case from the case measuring stage and to close flaps on the measured open case and to thereby produce a closed case, wherein the case closing stage comprises a dynamic closing mechanism comprising:

left and right contact bars, moved by left and right swing arms, respectively, the left swing arm and right swing arm pivoting about a left arm pivot axis and a right arm pivot axis, respectively, wherein the left arm pivot axis is on a right side of a centerline of the open case and the right arm pivot axis is on a left side of the centerline, and wherein the left and right swing arms are in a crossed relationship;

left and right gear sets, extending from the left and right swing arms, respectively, the left and right gear sets meshing together to result in synchronous movement of the left and right swing arms; and a lever arm, extending from one of the left and right swing arms, the lever arm driven by a power source;

a case sealing stage, vertically movable to an initial height set according to the calculated closed case height before the case arrives from the case closing stage, to seal the closed case, and to thereby produce a sealed case, wherein the second conveyor is deployed through the case closing stage and the case sealing stage;

a secondary height detection system, within the case sealing stage, to measure a height of the closed case and to direct the case sealing stage to move from the initial height to a subsequent height, the subsequent height determined by operation of a secondary height contact, the secondary height contact moved initially in a vertical direction based on movement of the case sealing stage and moved subsequently in a vertical direction based on physical contact with the closed case; and an output stage to accelerate the sealed case upon departure from the case sealing stage.

12. The apparatus of claim 11, wherein the secondary height detection system includes a damper, to damp motion of the secondary height contact upon contact with the closed case.

13. The apparatus of claim 11, additionally comprising contact rollers to engage upper portions of opposed vertically-oriented sidewalls of the closed case, the contact rollers configured for adjustable horizontal movement to provide adjustable pressure to the upper portions of the opposed vertically-oriented sidewalls, wherein the adjustable horizontal movement provides lateral support to the closed case as the closed case is measured by the secondary height detection system.

14. The apparatus of claim 11, additionally comprising an input gate to regulate movement of the open case, the input gate moveable between open and closed positions by an actuator, wherein a driven infeed roller is configured to propel the open case to a location within the input stage that allows a transverse flight element to push against the open case.

15. The apparatus of claim 11, additionally comprising an input stage having an input gate, the input gate having a first position to prevent passage of an open case and a second position to allow passage of the open case.

16. The apparatus of claim 11, additionally comprising:

an input stage having an input gate, the input gate having a first position to prevent passage of an open case and a second position to allow passage of the open case.

17. The apparatus of claim 11, wherein one of the first and second conveyors has a center flight lug and one of the first and second conveyors has split flight lugs.

* * * * *